US010030282B2

(12) United States Patent
Hayashi et al.

(10) Patent No.: US 10,030,282 B2
(45) Date of Patent: Jul. 24, 2018

(54) FERRITE-BASED STAINLESS STEEL PLATE HAVING EXCELLENT RESISTANCE AGAINST SCALE PEELING, AND METHOD FOR MANUFACTURING SAME

(71) Applicant: NIPPON STEEL & SUMIKIN STAINLESS STEEL CORPORATION, Tokyo (JP)

(72) Inventors: Atsutaka Hayashi, Hikari (JP); Yoshiharu Inoue, Kitakyushu (JP); Nobuhiko Hiraide, Shunan (JP)

(73) Assignee: NIPPON STEEL & SUMIKIN STAINLESS STEEL CORPORATION, Tokyo (JP)

( * ) Notice: Subject to any disclaimer, the term of this patent is extended or adjusted under 35 U.S.C. 154(b) by 140 days.

(21) Appl. No.: 14/374,497

(22) PCT Filed: Feb. 15, 2013

(86) PCT No.: PCT/JP2013/053665
§ 371 (c)(1),
(2) Date: Jul. 24, 2014

(87) PCT Pub. No.: WO2013/122191
PCT Pub. Date: Aug. 22, 2013

(65) Prior Publication Data

US 2014/0373980 A1 Dec. 25, 2014

(30) Foreign Application Priority Data

Feb. 15, 2012 (JP) ..... 2012-030141
Feb. 14, 2013 (JP) ..... 2013-027127

(51) Int. Cl.

| | |
|---|---|
| ***C21D 9/46*** | (2006.01) |
| ***C22C 38/54*** | (2006.01) |
| ***C22C 38/50*** | (2006.01) |
| ***C22C 38/48*** | (2006.01) |
| ***C22C 38/00*** | (2006.01) |
| ***C22C 38/44*** | (2006.01) |
| ***C22C 38/42*** | (2006.01) |
| ***C22C 38/06*** | (2006.01) |
| ***C22C 38/04*** | (2006.01) |
| ***C22C 38/02*** | (2006.01) |
| ***C21D 1/26*** | (2006.01) |
| ***C22C 38/46*** | (2006.01) |
| ***C25F 1/06*** | (2006.01) |
| ***C23F 17/00*** | (2006.01) |
| ***C23G 1/08*** | (2006.01) |
| ***C21D 1/76*** | (2006.01) |

(Continued)

(52) U.S. Cl.
CPC ..... *C21D 9/46* (2013.01); *C21D 1/26* (2013.01); *C21D 1/76* (2013.01); *C21D 6/002* (2013.01); *C21D 8/0278* (2013.01); *C21D 8/0473* (2013.01); *C21D 8/0478* (2013.01); *C21D 9/561* (2013.01); *C22C 38/00* (2013.01); *C22C 38/001* (2013.01); *C22C 38/004* (2013.01); *C22C 38/008* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C23F 17/00* (2013.01); *C23G 1/086* (2013.01); *C25F 1/06* (2013.01); *C21D 2211/005* (2013.01); *C23G 1/085* (2013.01); *F01N 2530/04* (2013.01)

(58) Field of Classification Search
CPC ..... C21D 1/26; C21D 1/76; C21D 2211/005; C21D 6/002; C21D 8/0278; C21D 8/0473; C21D 8/0478; C21D 9/46; C21D 9/561; C22C 38/00; C22C 38/001; C22C 38/004; C22C 38/008; C22C 38/02; C22C 38/04
See application file for complete search history.

(56) References Cited

U.S. PATENT DOCUMENTS 5,626,694 A 5/1997 Kawabata et al.
2008/0199638 A1 8/2008 Lin et al.
(Continued)

FOREIGN PATENT DOCUMENTS

CA 2697138 A1 2/2009
CA 2707518 A1 * 7/2009 ..... C22C 38/02
(Continued)

OTHER PUBLICATIONS

Canadian Office Action and Search Report dated Nov. 25, 2015, for Canadian Application No. 2,861,030.
(Continued)

*Primary Examiner* — Jenny R Wu
(74) *Attorney, Agent, or Firm* — Birch, Stewart, Kolasch & Birch, LLP

(57) ABSTRACT

This ferritic stainless steel sheet contains, by mass %: C: 0.02% or less, N: 0.02% or less, Si: 0.05% to 0.80%, Mn: 0.05% to 1.00%, P: 0.04% or less, S: 0.01% or less, Cr: 12% to 20%, Cu: 0.80% to 1.50%; Ni: 1.0% or less, Mo: 0.01% to 2.00%, Nb: 0.30% to 1.00%, Ti: 0.01% to less than 0.25%, Al: 0.003% to 0.46%, V: 0.01% to less than 0.15%, and B: 0.0002% to 0.0050%, with a remainder of Fe and inevitable impurities, wherein the following formulae (1) and (2) are satisfied, and an average Cu concentration in an area from a surface to a depth of 200 nm is 3.00% or less, in the case of Mn<0.65%, $$1.44\times Si-Mn-0.05\geq 0 \quad (1), \text{ and}$$

in the case of Mn≥0.65%, $$1.10\times Si+Mn-1.19\geq 0 \quad (2).$$

8 Claims, 2 Drawing Sheets

(51) Int. Cl.

| | |
|---|---|
| ***C21D 6/00*** | (2006.01) |
| ***C21D 8/02*** | (2006.01) |
| ***C21D 8/04*** | (2006.01) |
| ***C21D 9/56*** | (2006.01) |

(56) References Cited

U.S. PATENT DOCUMENTS

| | | | | |
|---|---|---|---|---|
| 2009/0000703 | A1 | 1/2009 | Hamada et al. | |
| 2009/0120536 | A1 | 5/2009 | Tomita et al. | |
| 2010/0050617 | A1* | 3/2010 | Oku | C21D 6/002 60/299 |
| 2010/0272594 | A1 | 10/2010 | Hiraide | |
| 2011/0176954 | A1 | 7/2011 | Oku et al. | |
| 2012/0020827 | A1 | 1/2012 | Nakamura et al. | |
| 2013/0004360 | A1 | 1/2013 | Kanno et al. | |

FOREIGN PATENT DOCUMENTS

| | | | | |
|---|---|---|---|---|
| CA | 2707518 | A1 | | 7/2009 |
| CN | 1380150 | A | | 11/2002 |
| CN | 1550565 | A | | 12/2004 |
| CN | 1788102 | A | | 6/2006 |
| CN | 101435054 | A | | 5/2009 |
| CN | 102131946 | A | | 7/2011 |
| EP | 0478790 | A1 | | 4/1992 |
| EP | 0 683 241 | A2 | | 11/1995 |
| EP | 1 249 513 | A1 | | 10/2002 |
| EP | 1 477 574 | A2 | | 11/2004 |
| EP | 1930461 | A1 | | 6/2008 |
| EP | 2112245 | A1 | | 10/2009 |
| EP | 2 351 868 | A1 | | 8/2011 |
| JP | 3-274245 | A | | 12/1991 |
| JP | 5-33104 | A | | 2/1993 |
| JP | 8-41600 | A | | 2/1996 |
| JP | 8-74079 | A | | 3/1996 |
| JP | 08060303 | A | * | 3/1996 |
| JP | 08074079 | A | * | 3/1996 |
| JP | 2696584 | B2 | | 1/1998 |
| JP | 2896077 | B2 | | 5/1999 |
| JP | 3067577 | A | | 7/2000 |
| JP | 3242007 | B2 | | 12/2001 |
| JP | 2004-218013 | A | | 8/2004 |
| JP | 2004-232074 | A | | 8/2004 |
| JP | 2005-171377 | A | | 6/2005 |
| JP | 2006-117985 | A | | 5/2006 |
| JP | 3926492 | B2 | | 6/2007 |
| JP | 2008-189974 | A | | 8/2008 |
| JP | 2008-197631 | A | | 8/2008 |
| JP | 2008-248329 | A | | 10/2008 |
| JP | 2008-297631 | A | | 12/2008 |
| JP | 2009-1834 | A | | 1/2009 |
| JP | 2009-68113 | A | | 4/2009 |
| JP | 2009-102728 | A | | 5/2009 |
| JP | 2009-120893 | A | | 6/2009 |
| JP | 2009-120894 | A | | 6/2009 |
| JP | 2009-167443 | A | | 7/2009 |
| JP | 2009-174046 | A | | 8/2009 |
| JP | 2009-197306 | A | | 9/2009 |
| JP | 2009-197307 | A | | 9/2009 |
| JP | 2009-215648 | A | | 9/2009 |
| JP | 2009-235555 | A | | 10/2009 |
| JP | 2010-121208 | A | | 6/2010 |
| JP | 2010-156039 | A | | 7/2010 |
| JP | 2011-68948 | A | | 4/2011 |
| JP | 4702493 | B1 | | 6/2011 |
| JP | 2011140709 | A | * | 7/2011 |
| JP | 2011-190468 | A | | 9/2011 |
| WO | WO 95/20683 | A1 | | 8/1995 |
| WO | WO 2011/024568 | A1 | | 3/2011 |
| WO | WO 2011/111871 | A1 | | 9/2011 |

OTHER PUBLICATIONS

Ito et al., "Development of Automatic Analyzer for Sulfuric Acid; Mixed Nitric Acid, and Hydrofluoric Acid in Stainless Pickling Process," Kagaku Kogaku Ronbunshu, vol. 25, No. 1, 1999, pp, 1-6.

Japanese Office Action, dated Jan. 12, 2016, for Japanese Application No. 2013-027127, with partial English translation.

JFE Steel Corporation, Stainless Steel for Automobile Brochure, pp. 1-23 (25 pages provided), with partial English translation, retrieved Dec. 31, 2015.

Nisshin Steel Co., Ltd., Stainless Steel Brochure, pp. 1-15 (16 pages provided), with partial English translation, retrieved Dec. 31, 2015.

International Search Report, dated May 7, 2013, issued in PCT/JP2013/053665.

Japanese Office Action, dated Jul. 12, 2016, for Japanese Application No. 2013-027127, along with an English translation.

International Search Report for International Application No. PCT/JP2013/056531, dated May 28, 2013.

Kato et al., "Development of a Ferritic Stainless Steel with Excellent Heat Resistance." Transactions of the Society of Automotive Engineers of Japan, vol. 39, No. 2, Mar. 25, 2008, pp. 329-333, including an English Abstract.

U.S. Office Action for U.S. Appl. No. 14/384,121, dated Mar. 2, 2017 (Non-Final Rejection).

Office Action with Search report (Including an English language translation of Search Report) issued in Chinese Patent Application No. 201380008761.5, dated Aug. 5, 2015.

* cited by examiner

FERRITE-BASED STAINLESS STEEL PLATE HAVING EXCELLENT RESISTANCE AGAINST SCALE PEELING, AND METHOD FOR MANUFACTURING SAME

TECHNICAL FIELD

With regard to heat-resistant stainless steel optimal for use in members in an automobile exhaust system particularly requiring high-temperature strength and oxidation resistance, the present invention relates to a ferrite-based stainless steel plate (ferritic stainless steel sheet) which is particularly excellent in terms of the resistance against scale peeling (resistance against scale spallation), and a method for manufacturing the same.

The present application claims priority on Japanese Patent Application No. 2012-030141 filed on Feb. 15, 2012 and Japanese Patent Application No. 2013-27127 filed on Feb. 14, 2013, the contents of which are incorporated herein by reference.

BACKGROUND ART

Since high-temperature exhaust gas exhausted from an engine passes through members in an automobile exhaust system such as an exhaust manifold, a front pipe, and a center pipe, a material configuring the members in an exhaust system is required to have a variety of characteristics such as oxidation resistance, high-temperature strength, and thermal fatigue characteristics.

In the past, it was usual to use cast iron for members in an automobile exhaust system; however, from the viewpoint of the intensification of exhaust gas regulations, the improvement of engine performance, a decrease in the weight of a vehicle frame and the like, there has been a trend of using more stainless steel exhaust manifolds. The temperature of exhaust gas varies depending on the types of vehicles, and the temperature of exhaust gas has been frequently in a range of approximately 750° C. to 850° C. in recent years, but there have also been cases in which the temperature of exhaust gas reaches a higher temperature. In an environment in which members in an exhaust system are used in the above-described temperature range for a long period of time, there is a demand for a material having high high-temperature strength and high oxidation resistance.

Among many types of stainless steel, austenitic stainless steel has excellent thermal resistance and workability. However, since austenitic stainless steel has a large thermal expansion coefficient, thermal fatigue failure is likely to occur in the case where austenitic stainless steel is applied to a member that is repetitively heated and cooled such as an exhaust manifold.

Compared with austenitic stainless steel, ferritic stainless steel has a lower thermal expansion coefficient; and therefore, ferritic stainless steel has excellent thermal fatigue characteristics. In addition, compared with austenitic stainless steel, ferritic stainless steel rarely contains expensive Ni; and therefore, the material cost is low, and thus ferritic stainless steel is widely used. However, ferritic stainless steel has a lower high-temperature strength compared with austenitic stainless steel; and therefore, techniques that improve high-temperature strength have been developed.

Examples of the above-described techniques include SUS430J1L (Nb-added steel), Nb—Si-added steel, and SUS444 (Nb—Mo-added steel) in which the high-temperature strength was improved by adding Si and Mo in addition to the basic addition of Nb. Among the above-described techniques, SUS444 had the highest strength since approximately 2% of Mo was added, but there were problems in that the workability was poor and the cost was high due to its high content of expensive Mo.

Therefore, in addition to the above-described alloys, a variety of additive elements have been studied. Patent Documents 1 to 4 disclose Cu addition techniques in which the solid solution strengthening of Cu and the precipitation strengthening of Cu using a precipitate (ε-Cu phase) are used.

However, there is a problem in that the addition of Cu degrades oxidation resistance. Oxidation resistance denotes two points that the mass gain is small without causing abnormal oxidation and the resistance against scale spallation is favorable.

In the case where stainless steel is heated, highly protective scales mainly containing $Cr_2O_3$ are generated in the surface. Cr is required to maintain the highly protective scales, and when Cr is not sufficiently supplied from a base metal, Fe is oxidized. At this time, in an oxide containing a large amount of Fe that is generated, the oxidation rate is extremely large. Therefore, the oxidation proceeds rapidly, and the base metal is greatly eroded. The above-described phenomenon is called abnormal oxidation.

In Patent Document 5, causes for the degradation of oxidation resistance by the addition of Cu are assumed. Cu is an austenite-forming element, and due to a decrease in the amount of Cr in a surface layer portion in response to the progress of oxidation, the phase transformation from the ferrite phase to the austenite phase is promoted only in the surface layer portion. Since Cr diffuses slowly in the austenite phase compared with the ferrite phase, when the austenite phase is formed in the surface layer portion, the supply of Cr from a base metal to scales is hindered. Then, it is assumed that the surface layer portion becomes deficient in Cr, and the oxidation resistance deteriorates. Therefore, a technique is disclosed which improves oxidation resistance by mutually adjusting a ferrite-forming element and an austenite-forming element and suppressing the austenite phase based on what has been described above.

However, even when favorable scales not causing abnormal oxidation can be formed, it is a problem if the scales are spalled off in, for example, the cooling process of an automobile exhaust system or the like. When the scales are spalled off, oxygen in the atmosphere comes into contact with the base metal during heating, and oxidation proceeds rapidly. If the scales cannot be protectively reproduced, abnormal oxidation may be caused. In addition, when the spalled scales are scattered, there is a possibility of the occurrence of problems such as the erosion of devices on the downstream side or the blocking of flow channels by the accumulation of the scales.

The scale spallation in members in an automobile exhaust system is frequently caused in the case where the thermal expansion difference is great between the base metal and an oxide and in the case where heating and cooling are repetitively carried out, and thermal stress is considered as a principal cause for the scale spallation. Since a thermal expansion difference between ferritic stainless steel and scales is smaller than a thermal expansion difference between austenitic stainless steel and scales, ferritic stainless steel is superior in terms of the resistance against scale spallation. In addition, a variety of techniques that improve the resistance against scale spallation in ferritic ferritic stainless steel have been developed.

Patent Document 6 discloses a method in which the Mn/Si ratio is adjusted to form a large amount of a Mn-containing spinel-based oxide having an intermediate thermal expansion rate between the thermal expansion rates of an oxide mainly containing $Cr_2O_3$ and the base metal; and thereby, the adhesion of scales is improved. However, it is necessary to set the Si concentration to be extremely higher (0.80% to 1.20% by mass %) than the Si concentration in ordinary ferritic stainless steel, and there is possibility of the workability being impaired. In addition, there is no disclosure regarding the thickness of the scales and the relationship between the shape of the interface between the scale and the base metal and the resistance against scale spallation.

Patent Document 7 discloses a method in which a small amount of Al is added to make scales fixed by "growing roots", but it is necessary to set the Si concentration to be extremely higher (0.80% to 1.50% by mass %) than the Si concentration in ordinary ferritic stainless steel, and there is possibility of the workability being impaired. In addition, there is no disclosure regarding the relationship between the thickness of the scales and the resistance against scale spallation.

Patent Document 8 discloses a method in which the integrated content of Mo and Si is regulated since the adhesion of $Cr_2O_3$ oxide and Si oxide is poor; however, the Si content is in a range of 0.10 wt % or less which is extremely lower than the Si content in ordinary ferritic stainless steel. In the case where Al is used as a deoxidizing agent, it is difficult to set the Si content to be in a range of 0.10% or less, and there is a possibility of the cost increasing. In the case where Al is not used, when the Si content is 0.10%, there is a concern of poor deoxidation, it becomes difficult to decrease the S content to an extremely low level, and there is a possibility of the cost increasing. In addition, there is no disclosure regarding the thickness of the scales and the relationship between the shape of the interface between the scale and the base metal and the resistance against scale spallation.

Patent Document 9 discloses a method in which the interface between scales and the base metal is made to be greatly uneven and entangled together and Ti is added to strengthen the scale-fixing action. However, since the Ti concentration is in a range of 0.23% to 1.0% by mass % which is extremely higher than that of ordinary ferritic stainless steel, there is a possibility of uniform elongation, hole expansibility, toughness and the like being impaired. In addition, there is no disclosure regarding the relationship between the thickness of the scales and the resistance against scale spallation.

According to what has been described above, the knowledge of the related art to improve the resistance against scale spallation of members in an automobile exhaust system was mainly about the improvement of the resistance against scale spallation by controlling the scale composition using Mn, Si, and Mo and the improvement of the resistance against scale spallation by controlling the shape of the interface between the scales and the base metal using Al and Ti, and there was no disclosure of knowledge to improve the resistance against scale spallation by controlling the thickness of scales. In addition, there was no disclosure of knowledge to improve the resistance against scale spallation by controlling the shape of the interface between the scale and the base metal using Mn and Si. Furthermore, it is necessary to control the Si content or the Ti content to be extremely high or low; and with the contents, there is a possibility of impairing workability, cost, uniform elongation, hole expansibility, toughness and the like. Therefore, there was no technique to improve the resistance against scale spallation in the Si or Ti content range of ordinary ferritic stainless steel.

In addition, while the reason is not clear, the addition of Cu degrades the resistance against scale spallation. In Patent Documents 6 and 7, the Cu content is in a range of 0.80% or less, and there is no assumption regarding the degradation of the resistance against scale spallation. That is, it was necessary to develop techniques to improve the resistance against scale spallation in Cu-added steel.

As described above, Cu-added steel is desirable for members in an automobile exhaust system in terms of high-temperature strength and cost, but there is a problem with oxidation resistance, particularly, the resistance against scale spallation.

PRIOR ART DOCUMENTS

Patent Documents

Patent Document 1: Japanese Unexamined Patent Application, First Publication No. 2008-189974

Patent Document 2: Japanese Unexamined Patent Application, First Publication No. 2009-120893

Patent Document 3: Japanese Unexamined Patent Application, First Publication No. 2009-120894

Patent Document 4: Japanese Unexamined Patent Application, First Publication No. 2011-190468

Patent Document 5: Japanese Unexamined Patent Application, First Publication No. 2009-235555

Patent Document 6: Japanese Patent No. 2896077

Patent Document 7: Japanese Patent No. 3067577

Patent Document 8: Japanese Patent No. 3242007

Patent Document 9: Japanese Patent No. 3926492

DISCLOSURE OF THE INVENTION

Problems to be Solved by the Invention

In the process of evaluating the resistance against scale spallation of Cu-added steel, the present inventors found that the thickness of scales and the shape of the interface between scales and the base metal have an influence on the resistance against scale spallation. In addition, the inventors also found that the average Cu concentration in the surface layer also has an influence on the resistance against scale spallation. Furthermore, the inventors found that, in a method for manufacturing a steel sheet, the average Cu concentration in the surface layer can be controlled by controlling finishing annealing (final annealing) after cold rolling and individual conditions of pickling in the subsequent processes. Furthermore, as a result of intensive studies regarding the influence of a variety of components, the inventors invented a ferritic stainless steel sheet having excellent resistance against scale spallation and a method for manufacturing the same.

The invention provides a ferritic stainless steel sheet having excellent resistance against scale spallation used in an environment in which, particularly, the peak temperature of exhaust gas reaches up to approximately 900° C. and a method for manufacturing the same.

Means for Solving the Problems

In order to solve the above-described problems, the inventors studied in detail the influence of the thickness of scales and the shape of the interface between scales and the base metal on the resistance against scale spallation of Cu-added ferritic stainless steel exposed to a high-temperature environment at 900° C. As a result, it was found that the scale spallation is caused by strain energy accumulated in the scales. The strain energy is accumulated in the scales due to thermal stress generated by the thermal expansion difference between the scales and the base metal in a heating or cooling process. It is considered that the scale spallation is caused due to the strain energy that is used as the energy of spalling the interface between the scales and the base metal. Furthermore, it was found that the thinning of scales and the intensification of the unevenness of the interface between the scales and the base metal improve the resistance against scale spallation.

It is considered that the thinning of scales decreases the total amount of the strain energy, and the intensification of the unevenness of the interface between scales and the base metal increases the interface area between scales and the base metal and disperses the energy used for the scale spallation; and therefore, the resistance against scale spallation is improved.

In the past, while it was considered that Si was not preferable and Mn was preferable from the viewpoint of the resistance against scale spallation, it was also found that the addition of Si and a decrease in the Mn content make scales thin and improve the resistance against scale spallation. In addition, while it was known that the addition of a large amount of Mn had an effect that forms a large amount of a spinel-based oxide containing Mn, it was found that the addition of a large amount of Mn also had an effect that intensifies the unevenness of the interface between scales and the base metal and an effect that improves the resistance against scale spallation.

That is, the addition of Mn has two conflicting effects, that is, an effect that thickens scales so as to deteriorate the resistance against scale spallation and an effect that intensifies the unevenness of the interface between scales and the base metal so as to improve the resistance against scale spallation. The resistance against scale spallation varies depending on the dominancy of the above-described two conflicting effects. It was found that, in a region with a low Mn content, the effect regarding the thickness of scales dominantly acts, and the resistance against scale spallation is deteriorated by the addition of Mn, and, in a region with a high Mn content, the effect regarding the interface between scales and the base metal dominantly acts, and the resistance against scale spallation is improved by the addition of Mn.

In addition, when Cu-added ferritic stainless steel is manufactured using an ordinary process, Cu in the surface layer is inevitably concentrated during final annealing and finishing pickling. Since the resistance against scale spallation is degraded by the addition of Cu, it is considered that the concentrated Cu in the surface layer further degrades the resistance against scale spallation. In order to solve this problem, the inventors studied in detail the influence of the Cu concentration in the surface layer on the resistance against scale spallation of Cu-added ferritic stainless steel exposed to a high-temperature environment at 900° C. As a result, the following matter was found: while the scale spallation is caused by the strain energy accumulated in the scales reaching certain critical energy, it is considered that Cu decreases the critical energy.

Since Cu in steel decreases the surface tension of the base metal, it is considered that Cu decreases the critical energy at which the scale spallation is caused. Therefore, it is considered that Cu-added steel is poor in terms of the resistance against scale spallation, and in addition, the concentrated Cu in the surface layer further degrades the resistance against scale spallation. That is, it was found that the suppression of the concentrating of Cu in the surface layer suppresses a decrease in the critical energy at which the scale spallation is caused, and has an effect to improve the resistance against scale spallation.

In addition, the inventors studied the conditions of a method for manufacturing a steel sheet, particularly, final annealing and a pickling process to suppress the concentrating of Cu in the surface layer. As a result, it was found that, when final annealing is carried out in a highly oxidizing atmosphere, not only Fe or Cr, which is easily oxidized, but also Cu is oxidized, and consequently, it is possible to decrease the average Cu concentration in the surface layer.

In addition, it was found that the average Cu concentration in the surface layer can be decreased by further suppressing the respective conditions of the final annealing and the pickling.

As a result of studying the above-described effects, a ferritic stainless steel having excellent resistance against scale spallation and a method for manufacturing the same were invented.

That is, the principal concept of one aspect of the invention to solve the above-described problems is as follows.

(1) A ferritic stainless steel sheet having excellent resistance against scale spallation, including, by mass %:

C: 0.02% or less;
N: 0.02% or less;
Si: 0.05% to 0.80%;
Mn: 0.05% to 1.00%;
P: 0.04% or less;
S: 0.01% or less;
Cr: 12% to 20%;
Cu: 0.80% to 1.50%;
Ni: 1.0% or less;
Mo: 0.01% to 2.00%;
Nb: 0.30% to 1.00%;
Ti: 0.01% to less than 0.25%;
Al: 0.003% to 0.46%;
V: 0.01% to less than 0.15%; and
B: 0.0002% to 0.0050%
with a remainder of Fe and inevitable impurities, in which the following formulae (1) and (2) are satisfied, and an average Cu concentration in an area from a surface to a depth of 200 nm is in a range of 3.00% or less, in the case of Mn<0.65%, $$1.44\times Si-Mn-0.06\geq 0 \quad (1), \text{ and}$$

in the case of Mn≥0.65%, $$1.10\times Si+Mn-1.19\geq 0 \quad (2),$$

herein, element symbols in the formulae represent contents (mass %) of the corresponding elements.

(2) The ferritic stainless steel sheet having excellent resistance against scale spallation according to the above-described (1), in which a mass gain is in a range of 1.50 $mg/cm^2$ or less and a mass of spalled scale is in a range of 0.30 $mg/cm^2$ or less after a continuous oxidation test in air at 900° C. for 200 hours.

(3) The ferritic stainless steel sheet having excellent resistance against scale spallation according to the above-described (1) or (2), further including, by mass %, one or two of W: 5% or less and Sn: 1% or less.

(4) A method for manufacturing the ferritic stainless steel sheet having excellent resistance against scale spallation according to any one of the above-described (1) to (3), including: final annealing; and finishing pickling. The final annealing is carried out in an oxidizing atmosphere having an oxygen proportion of 1.0 vol % or more and a volume ratio of oxygen/(hydrogen+carbon monoxide+hydrocarbon) of 5.0 or more, an annealing temperature T is set to be in a range of 850° C. to 1100° C., and an annealing time A is set to be in a range of 150 seconds or less. The finishing pickling is carried out through dipping treatment in a nitric hydrofluoric acid aqueous solution or electrolytic treatment in a nitric acid aqueous solution. In the case where the dipping treatment in a nitric hydrofluoric acid aqueous solution is carried out, a nitric acid concentration N is set to be in a range of 3.0 mass % to 20.0 mass %, a hydrofluoric acid concentration F is set to be in a range of 3.0 mass % or less, and a pickling time P is set to be in a range of 240 Amended Sheet (Article 34 of Patent Cooperation Treaty) seconds or less. In the case where the electrolytic treatment in a nitric acid aqueous solution is carried out, a nitric acid concentration N is set to be in a range of 3.0 mass % to 20.0 mass %, an electrolysis current density J is set to be in a range of 300 mA/cm$^2$ or less, a current applying time I is set to be in a range of 50 seconds or less, and a pickling time P is set to be in a range of 240 seconds or less. Conditions of the final annealing and the finishing pickling fulfill the following formula (3), $$T\times\log A\times((4.3\times F+0.12\times N)\times P+0.24\times J\times I)\times 10^{-6}\leq 5.0 \quad (3).$$

In addition, in the above-described one aspect of the invention, elements for which the lower limit is not specified may be contained up to an inevitable impurity level.

Effects of the Invention

According to the one aspect of the invention, it is possible to provide a ferritic stainless steel sheet having excellent resistance against scale spallation used in an environment in which, particularly, the peak temperature of exhaust gas reaches up to approximately 900° C. and a method for manufacturing the same.

In addition, according to the one aspect of the invention, excellent oxidation resistance, particularly, excellent resistance against scale spallation can be given to Cu-added ferritic stainless steel having excellent high-temperature strength. Therefore, when the one aspect of the invention is applied to members in an automobile exhaust system, a significant effect can be obtained for environmental measures, a decrease in the cost of components, and the like.

BRIEF DESCRIPTION OF THE DRAWINGS

FIG. 4 is a view illustrating the influence of the above-described formula (3) on the average Cu concentration in the area from the surface to a depth of 200 nm.

EMBODIMENTS OF THE INVENTION

Figure 1:
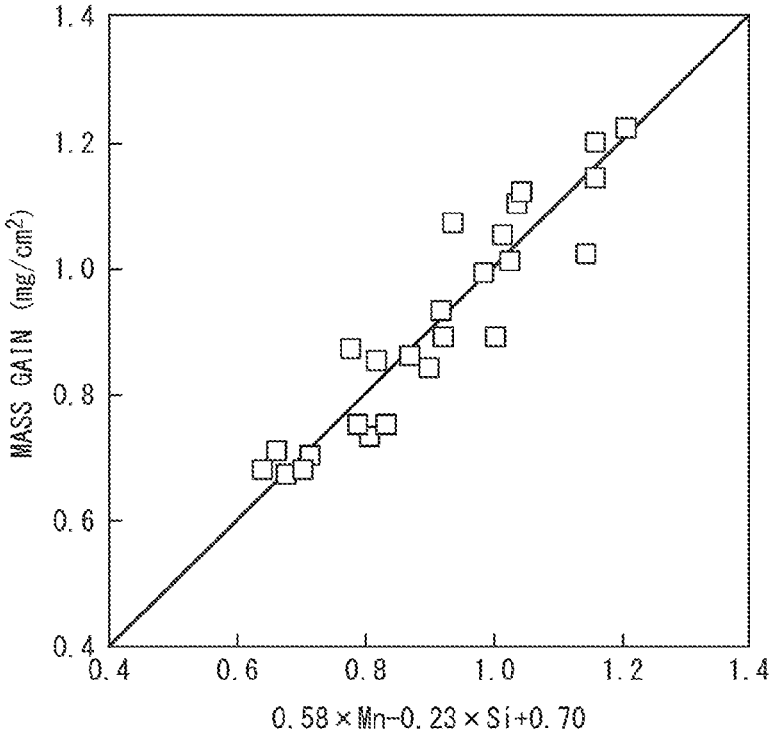
FIG. 1 is a view illustrating a relationship between values estimated using Si and Mn and actually measured values of the mass increase, that is, the mass gain after a continuous oxidation test in air at 900° C. for 200 hours for Invention Steels 1 to 15 and Comparative Steels 16 to 25 in Tables 1 and 2.

Embodiments and limiting conditions for carrying out the invention will be described in detail. Meanwhile, in the invention, unless particularly otherwise described, symbol "%" expressing the units of the contents of elements indicates "mass %". In the process of investigating the high-temperature characteristics of Cu-added ferritic stainless steel, the inventors found that the resistance against scale spallation differs greatly due to a slight difference of components and a difference of the Cu concentration in the surface layer.

First, in order to investigate the influence of components on the resistance against scale spallation and the oxidation resistance, Invention Steels 1 to 15 and Comparative Steels 16 to 41 in Tables 1 and 2 were subjected to a continuous oxidation test in air at 900° C. for 200 hours. Herein, in order to ignore the influence of the variation of the Cu concentration in the surface layer caused by the difference of the manufacturing method, and to purely study the influence of the components, the entire surface of a steel specimen was subjected to polish finishing using #600 polishing paper, and then the steel specimen was used as an oxidation test specimen. Meanwhile, a value obtained by dividing the value of the weight increase of the oxidation test specimen including spalled scales by the value of the surface area of the oxidation test specimen was used as a mass gain in evaluation.

In Comparative Steels 26 to 38 in Table 2 in which the mass gains were in a range of greater than 1.50 mg/cm$^2$ after the continuous oxidation test in air at 900° C. for 200 hours, a nodule made of an oxide containing a large amount of Fe was formed in the surface, and abnormal oxidation occurred. On the other hand, in Invention Steels 1 to 15 and Comparative Steels 16 to 25 in Tables 1 and 2, there was no similar nodule observed. Based on what has been described above, it was determined that, in the case where the mass gain is in a range of 1.50 mg/cm$^2$ or less, steel is not in an abnormal oxidation state, and steel exhibits favorable oxidation resistance; and therefore, the steel was evaluated as being normally oxidized.

Regarding the resistance against scale spallation, Invention Steels 1 to 15 and Comparative Steels 16 to 25 which are not in an abnormal oxidation state and are normally oxidized in Tables 1 and 2 are studied. In Comparative Steels 16 to 25 in Table 2 in which the masses of spalled scale were in a range of larger than 0.30 mg/cm$^2$, the metal surface was occasionally exposed due to the scale spallation. On the other hand, in Invention Steels 1 to 15 in Table 1, there was no exposed metal surface observed. There is no practical problem as long as steel comes into a spalled state in which the metal surface is exposed. Based on what has been described above, a case where the mass of spalled scale is in a range of 0.30 mg/cm$^2$ or less was set as a condition for excellent resistance against scale spallation.

As a result of intensive studies regarding components with which the mass of spalled scale becomes in a range of 0.30 mg/cm$^2$ or less and excellent resistance against scale spallation is obtained, the inventors could obtain the conditions of the following formulae (1) and (2) determined by Si and Mn.

In the case of Mn<0.65%, $$1.44\times Si-Mn-0.06\geq 0 \quad (1), \text{ and}$$

in the case of Mn≥0.65%, $$1.10\times Si+Mn-1.19\geq 0 \quad (2).$$

The above-described formulae were obtained in the following manner.

In normal oxidation, generally, the mass gain tends to be increased by the addition of Mn and the mass gain tends to be decreased by the addition of Si. Intensive studies in consideration of the above-described trend could lead to an estimated formula of the mass gain in normal oxidation as illustrated in FIG. 1, and the estimated formula is represented as the following formula (4) (data in FIG. 1 come from data in Tables 1 and 2).

$$\text{Mass gain (mg/cm}^2)=0.58\times Mn-0.23Si+0.70 \quad (4)$$

Figure 2:
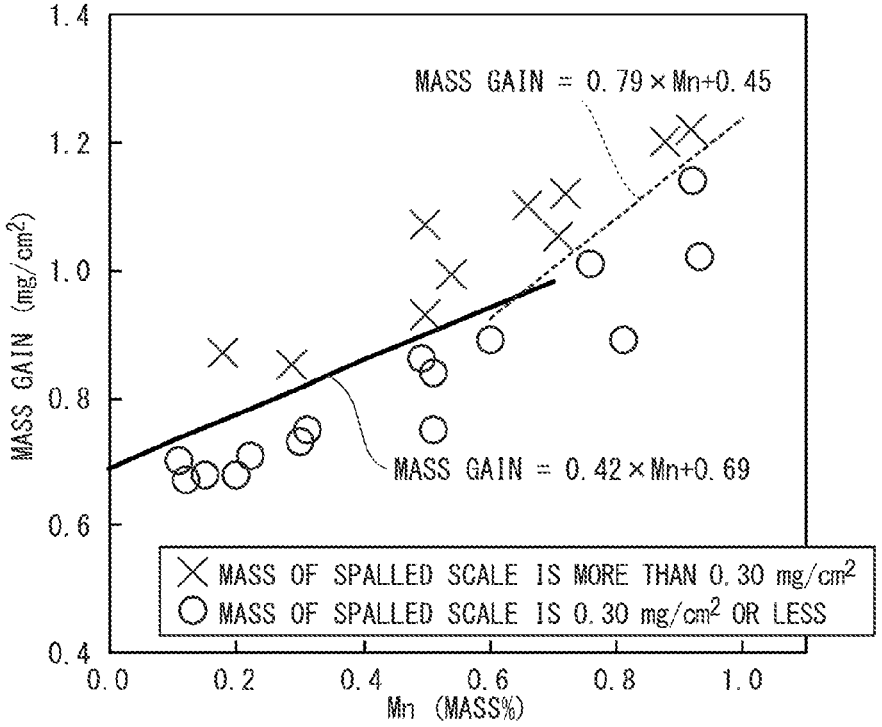
FIG. 2 is a view illustrating the influence of Mn and the mass gain on the scale spallation after the continuous oxidation test in air at 900° C. for 200 hours for Invention Steels 1 to 15 and Comparative Steels 16 to 25 in Tables 1 and 2.

Furthermore, as a result of intensive studies regarding conditions under which the mass of spalled scale becomes in a range of 0.30 mg/cm$^2$ or less after the continuous oxidation test in air at 900° C. for 200 hours, it was found that the conditions are dependent on Mn and the mass gain as illustrated in FIG. 2, and the conditions could be expressed by the following formulae (5) and (6) (data in FIG. 2 come from data in Tables 1 and 2).

In the case of Mn<0.65%, $$\text{Mass gain (mg/cm}^2)\leq 0.42\times Mn+0.69 \quad (5), \text{ and}$$

in the case of Mn≥0.65%, $$\text{Mass gain (mg/cm}^2)\leq 0.79\times Mn+0.45 \quad (6).$$

Formula (4) shows that, in the case where Si is added, the mass gain decreases. Furthermore, Formulae (5) and (6) shows that the resistance against scale spallation is improved by decreasing the mass gain through the addition of Si. When it is assumed that scales are spalled off by the strain energy accumulated in the scales, the decrease in the mass gain makes the scales thin, and decreases the total amount of the stain energy. Therefore, the resistance against scale spallation is considered to be improved by the addition of Si.

Formulae (5) and (6) show that, in the case where Mn is added, the resistance against scale spallation improves. During intensive studies, it was found that, due to the addition of Mn, a large amount of spinel-based oxide containing Mn is formed, and the interface between scales and the base metal becomes more uneven. Since the spinel-based oxide containing Mn has a thermal expansion similar to a thermal expansion of the base metal, strains are alleviated. When the interface between scales and the base metal becomes more uneven, the interface area between scales and the base metal is increased, and energy used for the scale spallation is dispersed. Therefore, the resistance against scale spallation is considered to be improved by the addition of Mn. However, Formula (4) also shows that the addition of Mn increases the mass gain. As a result, the resistance against scale spallation degrades.

Which of the conflicting effects of the addition of Mn on the resistance against scale spallation becomes dominant can be expected from the comparison of the slopes of the influence of Mn on the mass gain in Formulae (4), (5) and (6). That is, in the case of Mn<0.65%, the effect of the mass gain dominantly acts, and the resistance against scale spallation is degraded by the addition of Mn, and in the case of Mn 0.65%, a large amount of the spinel-based oxide containing Mn is formed, the effect of the interface between scales and the base metal becoming more uneven dominantly acts, and the resistance against scale spallation is improved by the addition of Mn.

Furthermore, a range in which the resistance against scale spallation was improved could be expressed by the following formulae (1) and (2) by substituting Formula (4) into the mass gain in Formulae (5) and (6) so as to express the formula only with Si and Mn.

In the case of Mn<0.65%, $$1.44\times Si-Mn-0.06\geq 0 \quad (1), \text{ and}$$

in the case of Mn≥0.65%, $$1.10\times Si+Mn-1.19\geq 0 \quad (2).$$

Figure 3:
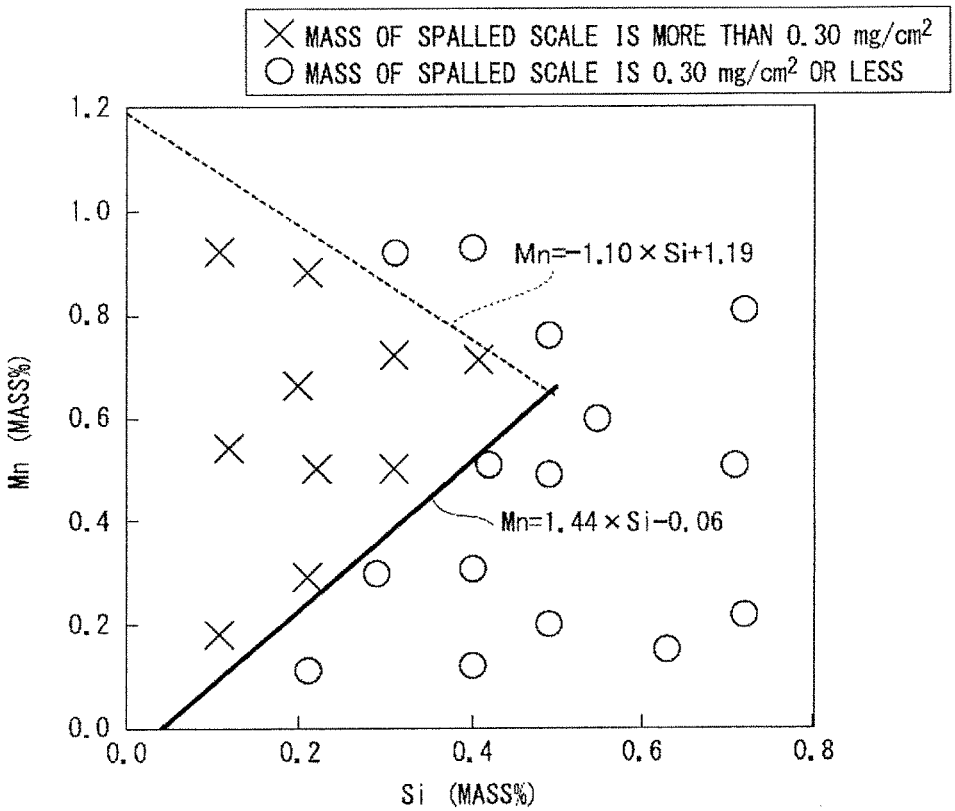
FIG. 3 is a view illustrating the influence of Si and Mn on the scale spallation after the continuous oxidation test in air at 900° C. for 200 hours for Invention Steels 1 to 15 and Comparative Steels 16 to 25 in Tables 1 and 2.

Here, a graph illustrating the influence of Si and Mn on the scale spallation after the continuous oxidation test in air at 900° C. for 200 hours is illustrated in FIG. 3 (data in FIG. 3 come from data in Tables 1 and 2).

As is evident from the graph illustrated in FIG. 3, it is found that, in a range of Mn<0.65, the resistance against scale spallation is improved by decreasing the mass gain through the addition of Si, on the other hand, in a range of Mn≥0.65%, a large amount of the spinel-based oxide containing Mn is formed, the effect of the interface between scales and the base metal becoming more uneven dominantly acts, and the resistance against scale spallation is improved by the addition of Mn.

Next, in order to investigate the influence of the Cu concentration in the surface layer on the resistance against scale spallation, with regard to Invention Examples a to d and Comparative Examples e to o which were manufactured using Invention Steels 3, 5, and 11 in Table 1 under individual conditions in Table 3, the Cu concentration in the surface layer was analyzed through glow discharge optical emission spectrometry (GDS), and a continuous oxidation test was carried out in air at 900° C. for 200 hours. Since the investigation aimed to investigate the influence of the variation of the Cu concentration in the surface layer caused by the difference of the manufacturing method, test specimen produced using Invention Examples a to d and Comparative Examples e to o were used as test specimens for the GDS analysis and the oxidation test without carrying out polishing so as to maintain the surface unchanged after being manufactured.

In Comparative Examples e to o in Table 3 in which the masses of spalled scale are in a range of larger than 0.30 mg/cm$^2$ after the continuous oxidation test in air at 900° C. for 200 hours, the metal surface was occasionally exposed due to the scale spallation. On the other hand, Invention Examples a to d in Table 3 had no exposed metal surface observed and exhibited the resistance against scale spallation as excellent as that of Invention Steels 3, 5, and 11 in Table 1 in which the surfaces were subjected to polish finishing by #600 polishing paper so that concentrating of Cu was ignored.

The mass gains of Invention Examples a to d and Comparative Examples e to o in Table 3 were equal to the mass gains of Invention Steels 3, 5, and 11 in Table 1 having an equivalent mass gain and an equivalent steel type, and there was no difference in the scale thickness. In addition, it was confirmed that there was no difference in the unevenness of the interface between scales and the base metal between the corresponding pairs having an equivalent steel type. That is, there was no difference in the strain energy accumulated in the scales used for the scale spallation.

Therefore, as a result of intensively studying the Cu concentration in the surface layer to obtain a mass of spalled scale of 0.30 mg/cm$^2$ or less and excellent resistance against scale spallation, the inventors could obtain a condition to set the average Cu concentration in an area from the surface to a depth of 200 nm to be in a range of 3.00% or less.

Hereinafter, a method for measuring the average Cu concentration in an area from the surface to a depth of 200 nm will be described.

First, in the test specimen before the oxidation test, the concentration distribution of O, Fe, Cr, Si, Mn, Mo, Nb, Ti, Al and Cu is measured in an area from the surface of the test specimen to a depth of approximately 800 nm through GDS analysis. At this time, the Cu concentration obtained through GDS analysis is expressed as the Cu concentration with respect to the total amount of O, Fe, Cr, Si, Mn, Mo, Nb, Ti, Al and Cu. The average Cu concentration in an area from the surface to a depth of 200 nm is computed using the above-described Cu concentration. Here, the surface includes a passive film.

The scale spallation is considered to be caused by the strain energy accumulated in the scales, and it is considered that a decrease in the mass gain makes the scales thin and the total amount of the strain energy is decreased, and it is also considered that the intensification of the unevenness of the interface between the scales and the base metal increases the interface area between the scales and the base metal and the resistance against scale spallation is improved by dispersing energy used for the scale spallation. Furthermore, since the scale spallation is considered to be caused in the case where the strain energy which is accumulated in the scales and is used for the scale spallation reaches a certain amount or more, it is considered that there is a critical energy at which the scale spallation occurs. When the critical energy is decreased, the resistance against scale spallation is considered to degrade.

In Invention Examples a to d and Comparative Examples e to o in Table 3, there was no difference in the strain energy which is accumulated in the scales and is used for the scale spallation, but the resistance against scale spallation was degraded as the average Cu concentration in an area from the surface to a depth of 200 nm increased. That is, an increase in the average Cu concentration in an area from the surface to a depth of 200 nm is considered to decrease the critical energy at which the scale spallation is caused.

The critical energy at which the scale spallation is caused is considered to be dependent on the surfaces of the scales and the base metal and the properties of the interface therebetween. When scales are spalled off, new surfaces are generated on the scales and the base metal, and surface tension is newly applied to the respective new surfaces. On the other hand, since the interface between the scales and the base metal vanishes, the surface tension is relieved. That is, it is considered that, for the scale spallation, an amount of energy is required which corresponds to an amount obtained by subtracting the interface tension between the scales and the base metal from the total surface tension of the scales and the base metal. That is, it is considered that, when the surface tensions of the scales and the base metal increase, the critical energy at which the scale spallation is caused is increased, and, when the interface tension between the scales and the base metal increases, the critical energy at which the scale spallation is caused is decreased.

Herein, Cu in steel is an element decreasing the surface tension of the base metal. Therefore, it is considered that an increase in the average Cu concentration in an area from the surface to a depth of 200 nm causes a decrease in the surface tension of the base metal, the critical energy at which the scale spallation is caused decreases, and the resistance against scale spallation degrades.

Based on what has been described above, the average Cu concentration in an area from the surface to a depth of 200 nm is set to be in a range of 3.00% or less.

Furthermore, studies were conducted regarding the effects of individual elements; and thereby, a ferritic stainless steel sheet having excellent resistance against scale spallation was obtained.

Hereinafter, the reasons for limiting individual compositions in the embodiments will be described.

(C: 0.02% or Less)

C deteriorates formability and corrosion resistance, and C decreases high-temperature strength. Furthermore, in the case where Cu is added, oxidation resistance is also degraded; and therefore, the content of C is preferably as small as possible. Therefore, the content of C is set to be in a range of 0.02% or less, and preferably in a range of 0.015% or less. However, since an excessive decrease in the content of C leads to an increase in the refining cost, the lower limit is desirably set to 0.001%.

(N: 0.02% or Less)

Similar to C, N deteriorates formability and corrosion resistance, and N decreases high-temperature strength. In the case where Cu is added, oxidation resistance is also degraded; and therefore, the content of N is preferably as small as possible. Therefore, the content of N is set to be in a range of 0.02% or less. However, since an excessive decrease in the content of N leads to an increase in the refining cost, the lower limit is desirably set to 0.003%.

(Si: 0.05% to 0.80%)

Si is an element added as a deoxidizing agent, and in addition, Si is an important element to improve oxidation resistance. Addition of 0.05% or more of Si is required to maintain oxidation resistance. In addition, in the range of the embodiments, the addition of Si makes scales thin and improves the resistance against scale spallation as described above. However, when Si is excessively added, Si oxide having poor scale adhesion is generated, and there is a possibility of degrading the resistance against scale spallation. Therefore, the content of Si is set to be in a range of 0.80% or less. Furthermore, when the fact that an excessive decrease in the content of Si causes poor deoxidation or a cost increase and excessive addition degrades workability is taken into account, the lower limit is desirably set to 0.10%, and the upper limit is desirably 0.75%.

(Mn: 0.05% to 1.00%)

Mn is an element added as a deoxidizing agent, and in addition, Mn is an element having an effect on the resistance against scale spallation. There are a range in which a decrease in the content of the Mn makes scales thin and improves the resistance against scale spallation and a range in which the intensification of the unevenness of the interface between scales and the base metal improves the resistance against scale spallation as described above. In a range in which the above-described effects are developed, a spinel-based oxide containing Mn is formed, and addition of 0.05% or more of Mn is required. On the other hand, excessive addition of Mn causes an increase in the oxidation rate such that abnormal oxidation is likely to occur. Furthermore, Mn is an austenite-forming element; and therefore, the addition of Mn is preferably suppressed in Cu-added ferritic steel of the embodiment. Therefore, the content of Mn is set to be in a range of 1.00% or less. Furthermore, when the fact that an excessive decrease in the content of Mn causes a cost increase and excessive addition does not only degrade uniform elongation at room temperature but also forms MnS so as to degrade corrosion resistance is taken into account, the lower limit is desirably set to 0.10%, and the upper limit is desirably 0.95%.

(P: 0.04% or Less)

P is an impurity incorporated mainly from a raw material during the manufacturing and refining of steel, and an increase in the content of P degrades toughness or weldability; and therefore, the content of P is extremely decreased. However, since an extreme decrease in the content of P causes a cost increase, the content of P is set to be in a range of 0.04% or less.

(S: 0.01% or Less)

S is an impurity incorporated mainly from a raw material during the manufacturing and refining of steel, and an increase in the content of S degrades the resistance against scale spallation due to segregation in the interface between scales and the base metal and a decrease in the surface tension of the base metal. However, since an extreme decrease in the content of S causes a cost increase, the content of S is set to be in a range of 0.01% or less.

(Cr: 12% to 20%)

Cr is an extremely effective element for conferring oxidation resistance, and addition of 12% or more of Cr is required to maintain oxidation resistance. On the other hand, when the content of Cr exceeds 20%, not only does workability degrade but toughness also deteriorates; and therefore, the content of Cr is set to be in a range of 12% to 20%. Furthermore, when high-temperature strength, high-temperature fatigue characteristics, and manufacturing cost are taken into account, the lower limit is desirably set to 13%, and the upper limit is desirably 18%. The content of Cr is more desirably in a range of 13.5% to 17.5%.

(Cu: 0.80% to 1.50%)

Cu is an effective element for improving high-temperature strength. This is due to precipitation hardening caused by the precipitation of ε-Cu, and the effect is developed when 0.80% or more of Cu is added. However, Cu is an austenite-forming element, Cu promotes the phase transformation from the ferrite phase to the austenite phase occurring only in the surface layer section caused by a decrease in the content of Cr in the surface layer portion as oxidation proceeds, and Cu deteriorates oxidation resistance. Therefore, the content of Cu is set to be in a range of 1.50% or less. Furthermore, when manufacturability and press formability are taken into account, the lower limit is desirably set to 0.90%, and the upper limit is desirably 1.40%.

(Ni: 1.0% or Less)

Ni is an element improving corrosion resistance, and is an austenite-stabilizing element. Since Ni degrades oxidation resistance and is expensive, the content of Ni is decreased as much as possible. Therefore, the content of Ni is set to be in a range of 1.0% or less. Furthermore, when manufacturability, manufacturing costs and workability are taken into account, the lower limit is desirably set to 0.01%, and the upper limit is desirably 0.5%.

(Mo: 0.01% to 2.00%)

Mo is effective for improving corrosion resistance, suppressing high-temperature oxidation, and improving high-temperature strength through solid solution strengthening. In addition, Mo is a ferrite-forming element, and Mo also has an effect of improving oxidation resistance in Cu-added ferritic steel of the embodiment; and therefore, 0.01% or more of Mo is added. However, Mo is expensive, and Mo degrades uniform elongation at room temperature. Therefore, the content of Mo is set to be in a range of 2.00% or less. Furthermore, when manufacturability and cost are taken into account, the lower limit is desirably set to 0.05%, and the upper limit is desirably 1.50%.

(Nb: 0.30% to 1.00%)

Nb improves high-temperature strength through solid solution strengthening and precipitate refinement strengthening, and in addition, Nb fixes C and N as carbonitrides, and Nb improves corrosion resistance and oxidation resistance; and therefore, 0.30% or more of Nb is added. However, excessive addition degrades uniform elongation and deteriorates hole expansibility. Therefore, the content of Nb is set to be in a range of 1.00% or less. Furthermore, when the intergranular corrosion property of a welded portion, manufacturability and manufacturing cost are taken into account, the lower limit is desirably set to 0.40%, and the upper limit is desirably 0.70%.

(Ti: 0.01% to less than 0.25%)

Ti is an element that bonds with C, N, and S so as to improve corrosion resistance, intergranular corrosion resistance, and the r value which serves as an index for deep drawability. In addition, Ti is a ferrite-forming element, and Ti also has an effect of improving oxidation resistance in Cu-added ferritic steel of the embodiment; and therefore, 0.01% or more of Ti is added. However, when Ti is excessively added, the amount of solid-solubilized Ti increases so as to degrade uniform elongation. and Ti form a coarse Ti-based precipitate which serves as the starting point of cracking during hole-expanding process; and thereby, hole expandability is deteriorated. Therefore, the content of Ti is set to be in a range of less than 0.25%. Furthermore, when the generation of surface defects and toughness are taken into account, the lower limit is desirably set to 0.03%, and the upper limit is desirably 0.21%.

(Al: 0.003% to 0.46%)

Al is an element that is added as a deoxidizing element, and Al improves oxidation resistance. In addition, since Al is useful for improving high-temperature strength as a solid solution strengthening element, 0.003% or more of Al is added. However, excessive addition hardens steel so as to greatly degrade uniform elongation, and Al also greatly degrades toughness. Therefore, the content of Al is set to be in a range of 0.46% or less. Furthermore, when the generation of surface defects, weldability and manufacturability are taken into account, the lower limit is desirably set to 0.01%, and the upper limit is desirably 0.20%.

(V: 0.01% to Less than 0.15%)

V forms fine carbonitrides; and thereby, a precipitation strengthening action is generated. As a result, V contributes to the improvement of high-temperature strength. In addition, V is a ferrite-forming element, and V also has an effect of improving oxidation resistance in Cu-added ferritic steel of the embodiment; and therefore, 0.01% or more of V is added. However, excessive addition coarsens a precipitate so as to decrease high-temperature strength and degrade thermal fatigue life. Therefore, the content of V is set to be in a range of less than 0.15%. Furthermore, when manufacturing cost and manufacturability are taken into account, the lower limit is desirably set to 0.02%, and the upper limit is desirably 0.10%.

(B: 0.0002% to 0.0050%)

B is an element that improves high-temperature strength and thermal fatigue characteristics. In addition, B preferentially diffuses and segregates in the interface between scales and the base metal and the grain boundaries compared with P or S; and thereby, B has an effect that suppresses the segregation of P or S in grain boundaries which is harmful to oxidation resistance. As a result, B also has an effect of improving oxidation resistance; and therefore, 0.0002% or more of B is added. However, excessive addition degrades hot workability and the surface properties of the steel surface. Therefore, the content of B is set to be in a range of 0.0050% or less. Furthermore, when formability and manufacturing cost are taken into account, the lower limit is desirably set to 0.0003%, and the upper limit is desirably 0.0015%.

Furthermore, a mass gain per unit area in the continuous oxidation test in air for 200 hours is used as an index for oxidation resistance at 900° C. In the case where the above-described value is in a range of 1.50 mg/cm$^2$ or less, steel is considered to be not in an abnormal oxidation state and to exhibit favorable oxidation resistance.

In addition, regarding the scale spallation, in the case where the mass of spalled oxidized scales is in a range of 0.30 mg/cm$^2$ or less, steel does not come into a spalled state in which the metal surface is exposed, and thus, steel has no practical problem. Therefore, the above-described value is preferably set as the upper limit. A case where the scale spallation does not occur is more preferable.

Additionally, in the embodiment, the characteristics can be further improved by adding W and/or Sn.

(W: 5% or Less)

W is an element that has the same effect as Mo and improves high-temperature strength. However, excessive addition forms a solid solution in the Laves phase, coarsens a precipitate, and deteriorates manufacturability. Therefore, the content of W is desirably set to be in a range of 5% or less. Furthermore, when costs, oxidation resistance and the like are taken into account, it is more desirable to set the lower limit to 1% and to set the upper limit to 3%.

(Sn: 1% or Less)

Sn has a large atomic radius, and Sn is an effective element for solid solution strengthening, and Sn does not greatly deteriorate mechanical characteristics at room temperature. However, excessive addition greatly deteriorates manufacturability. Therefore, the content of Sn is desirably set to be in a range of 1% or less. Furthermore, when the oxidation resistance and the like are taken into account, it is preferable to set the lower limit to 0.05% and to set the upper limit to 0.50%.

Next, a method for manufacturing a ferritic stainless steel sheet having excellent resistance against scale spallation in the embodiment will be described.

An ordinary process through which ferritic stainless steel is manufactured is employed as the method for manufacturing a steel sheet of the embodiment. Generally, steel is melted using a converter or an electric furnace, and the steel is refined using an AOD furnace, a VOD furnace or the like. A slab is produced using a continuous casting method or an ingot method, and then the slab is subjected to processes of hot rolling-annealing of a hot-rolled sheet-pickling-cold rolling-finishing annealing (final annealing)-pickling (finishing pickling); and thereby, a steel sheet is manufactured. Depending on necessity, the annealing of the hot-rolled sheet may not be carried out, and the process of cold rolling-finishing annealing-pickling may be carried out repeatedly.

Ordinary conditions may be employed as the conditions for the hot rolling and the annealing of the hot-rolled sheet, and it is possible to carry out the hot rolling and the annealing, for example, at a hot rolling heating temperature in a range of 1000° C. to 1300° C. and an annealing temperature of the hot-rolled sheet in a range of 900° C. to 1200° C. Here, the embodiment is not characterized by the manufacturing conditions of the hot rolling and the annealing of the hot-rolled sheet, and the manufacturing conditions thereof are not limited. Therefore, as long as manufactured steel is capable of obtaining the effects of the embodiment, it is possible to appropriately select hot rolling conditions, the execution of the annealing of the hot-rolled sheet, the annealing temperature of the hot-rolled sheet, atmosphere and the like. In addition, the cold rolling before the final annealing can be carried out at a cold rolling reduction of 30% or more. Meanwhile, in order to obtain a recrystallized structure having favorable workability by relieving strains or residual stress, it is necessary to supply a large amount of strains which serves as the driving force for recrystallization, and the cold rolling reduction is desirably set to be in a range of 50% or more. In addition, an ordinary treatment may be carried out as a treatment before the finishing pickling, and examples thereof that can be carried out include mechanical treatments such as shot blasting and grinding brushing and chemical treatments such as a molten salt treatment and an electrolytic treatment in a neutral salt solution. In addition, temper rolling or tension leveler may be supplied after the cold rolling and the annealing. Furthermore, the thickness of the product sheet may also be selected depending on the required thickness of the member. In addition, it is also possible to manufacture a welded pipe using the above-described steel sheet as a material and an ordinary method for manufacturing a stainless steel pipe for a member in an exhaust system such as electric resistance welding, TIG welding or laser welding.

However, the final annealing is carried out in an oxidizing atmosphere having an oxygen proportion of 1.0 vol % or more and a volume ratio of oxygen/(hydrogen+carbon monoxide+hydrocarbon) of 5.0 or more, the annealing temperature T is set to be in a range of 850° C. to 1100° C., the annealing time A is set to be in a range of 150 seconds or less, the finishing pickling is carried out through dipping treatment in a nitric hydrofluoric acid aqueous solution or electrolytic treatment in a nitric acid aqueous solution, the nitric acid concentration N is set to be in a range of 3.0 mass % to 20.0 mass %, the hydrofluoric acid concentration F is set to be in a range of 3.0 mass % or less, the electrolysis current density J is set to be in a range of 300 mA/cm$^2$ or less, the pickling time P is set to be in a range of 240 seconds or less, the current applying time I is set to be in a range of 50 seconds or less, and the following formula (3) is satisfied, $$T\times\log A\times((4.3\times F+0.12\times N)\times P+0.24\times J\times I)\times 10^{-6}\leq 5.0 \quad (3).$$

Hereinafter, a method for manufacturing a ferritic stainless steel sheet having excellent resistance against scale spallation in the embodiment will be described in detail.

The reason for carrying out the final annealing in an oxidizing atmosphere having an oxygen proportion of 1.0 vol % or more and a volume ratio of oxygen/(hydrogen+carbon monoxide+hydrocarbon) of 5.0 or more is to decrease the Cu concentration in the surface layer. In the case where the oxidation property of the final annealing is high, Cu is also oxidized, but Fe and Cr which are more easily oxidized than Cu are preferentially oxidized. Therefore, since non-oxidized Cu remains immediately below scales, the Cu concentration in the surface layer increase. However, in the case where the oxidation property of the final annealing is low, Cu is not oxidized, only Fe and Cr are oxidized, and the Cu concentration in the surface layer greatly increases. Therefore, in order to suppress an increase in the Cu concentration in the surface layer to a low level and to set the average Cu concentration to be in a range of 3.00% or less, it is necessary to increase the oxidation property of the final annealing. Therefore, as a result of intensive studies regarding the oxidation property of the final annealing and the atmosphere composition, the inventors set the atmosphere of the final annealing to an oxidizing atmosphere having an oxygen proportion of 1.0 vol % or more and a volume ratio of oxygen/(hydrogen+carbon monoxide+hydrocarbon) of 5.0 or more.

The annealing temperature T of the final annealing is required to be set to be in a range of 850° C. to 1100° C. In the case where the annealing temperature T is excessively high, the oxidation is promoted, and the Cu concentration in the surface layer is also promoted. Therefore, the annealing temperature is set to be in a range of 1100° C. or lower. In addition, in consideration of the fact that the steel is to be recrystallized with short annealing, the annealing temperature is set to be in a range of 850° C. or higher.

The annealing time A of the final annealing is required to be set to be in a range of 150 seconds or less. When the annealing time A increases, the oxidation proceeds, and an increase in the Cu concentration in the surface layer also proceeds. Therefore, the annealing time is set to be in a range of 150 seconds or less.

The finishing pickling aims to remove scale films formed by the final annealing. At this time, since Fe and Cr are preferentially pickled and dissolved, Cu remains, and the Cu concentration in the surface layer increases. Therefore, it is necessary to limit the finishing pickling conditions. Here, examples of the pickling includes dipping treatment in a nitric hydrofluoric acid aqueous solution, electrolytic treatment in a nitric acid aqueous solution, dipping treatment in a sulfuric acid aqueous solution, and the like. As a result of intensive studies, the inventors set the pickling conditions to dipping treatment in a nitric hydrofluoric acid aqueous solution or electrolytic treatment in a nitric acid aqueous solution because dipping treatment in a sulfuric acid aqueous solution greatly increases the Cu concentration in the surface layer.

In the dipping treatment in a nitric hydrofluoric acid aqueous solution, it is necessary to set the nitric acid concentration N to be in a range of 3.0 mass % to 20.0 mass % and it is necessary to set the hydrofluoric acid concentration F to be in a range of 3.0 mass % or less. In the case where the nitric acid concentration N is less than 3.0 mass %, scales are rarely removed in the pickling. On the other hand, when the nitric acid concentration N exceeds 20.0 mass %, or the hydrofluoric acid concentration F exceeds 3.0 mass %, an increase in the Cu concentration in the surface layer is promoted. In addition, a dissolution reaction greatly proceeds, and the surface becomes greatly uneven due to dissolution. This degree of unevenness provides a product sheet with streaky markings or irregular markings; and therefore, the quality of the product degrades.

In the electrolytic treatment in a nitric acid aqueous solution, the electrolysis current density J is required to be set to be in a range of 300 mA/cm$^2$ or less. In the case where the electrolysis current density J exceeds 300 mA/cm$^2$, an increase in the Cu concentration in the surface layer is promoted. In addition, a dissolution reaction greatly proceeds, and the surface becomes greatly uneven due to dissolution. This degree of unevenness provides a product sheet with streaky markings or irregular markings; and therefore, the quality of the product degrades.

In addition, in both of the dipping treatment in a nitric hydrofluoric acid aqueous solution and the electrolytic treatment in a nitric acid aqueous solution, the pickling time P is required to be set to be in a range of 240 seconds or less. Furthermore, in the electrolytic treatment in a nitric acid aqueous solution, the current applying time I is required to be set to be in a range of 50 seconds or less. Here, the current applying time I refers to a period of time during which electrical current is applied within the pickling time. In the case where the pickling time P exceeds 240 seconds, or the current applying time I exceeds 50 seconds, an increase in the Cu concentration in the surface layer is promoted. In addition, a dissolution reaction greatly proceeds, and the surface becomes greatly uneven due to dissolution. This degree of unevenness provides a product sheet with streaky markings or irregular markings; and therefore, the quality of the product degrades.

Figure 4:
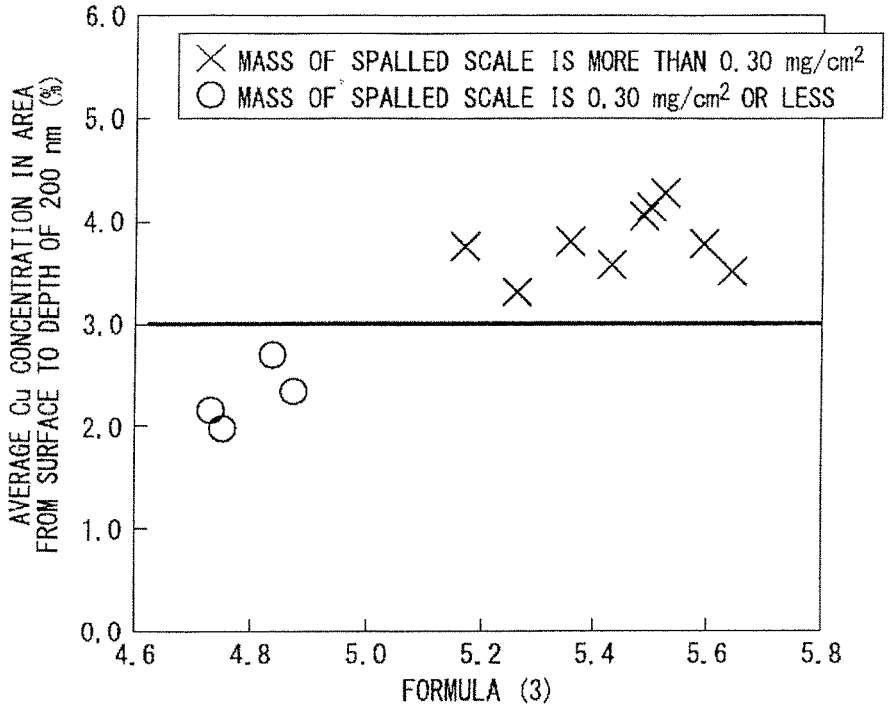
FIG. 4 is a view illustrating the influence of an average Cu concentration in an area from a surface to a depth of 200 nm on the scale spallation after the continuous oxidation test in air at 900° C. for 200 hours for Invention Examples a to d and Comparative Examples e to m manufactured using Invention Steels 3, 5, and 11 in Table 1 under individual conditions in Table 3. In addition.

Furthermore, as a result of intensive studies regarding the correlation between the final annealing conditions and the finishing pickling conditions for setting the average Cu concentration in an area from the surface to a depth of 200 nm to be in a range of 3.00% or less, the inventors found that the annealing temperature T, the annealing time A, the nitric acid concentration N, the hydrofluoric acid concentration F, the electrolysis current density J, the pickling time P, and the current applying time I comprehensively have an influence on the average Cu concentration in an area from the surface to a depth of 200 nm as illustrated in FIG. 4, and the inventors could obtain the conditions of the following formula (3) (Data in FIG. 4 come from data in Table 3).

$$T\times\log A\times((4.3\times F+0.12\times N)\times P+0.24\times J\times I)\times 10^{-6}\leq 5.0 \quad (3).$$

When the final annealing and the finishing pickling are carried out under conditions in which the above-described annealing conditions and finishing pickling conditions are satisfied and Formula (3) is also satisfied, it becomes possible to set the average Cu concentration in an area from the surface to a depth of 200 nm to be in a range of 3.00% or less.

Meanwhile, in the case where dipping treatment in a nitric hydrofluoric acid aqueous solution is carried out as the finishing pickling, the electrolysis current density J and the current applying time I in Formula (3) are set to "zero", and in the case where electrolytic treatment in a nitric acid aqueous solution is carried out as the finishing pickling, the hydrofluoric acid concentration F in Formula (3) is set to "zero" for computation.

EXAMPLES

Hereinafter, the effects of the embodiment will be further clarified using examples. Meanwhile, the embodiment is not limited to the following examples, and the embodiment can be appropriately modified within the scope of the purpose of the embodiment.

Test materials having the component compositions described in Tables 1 and 2 (Invention Steels 1 to 15 and Comparative Steels 16 to 41) were melted in a vacuum melting furnace, and ingots of 30 kg were casted. The obtained ingots were made into hot-rolled steel sheets having a thickness of 4.5 mm. The heating condition of hot rolling was 1200° C. The hot-rolled sheets were annealed at 1000° C. A descale treatment using alumina blasting was conducted, and then the hot-rolled sheets were subjected to cold rolling to be made into sheets having a thickness of 1.5 mm, and finishing annealing was carried out by holding the sheets at 1100° C. Test specimens having a thickness of 1.5 mm, a width of 20 mm, and a length of 25 mm were sampled from the cold-rolled and annealed sheets obtained in the above-described manner, and the test specimens were subjected to polish finishing using #600 polishing paper, and the polish-finished test specimens were used as oxidation test specimens.

TABLE 1

| | | Chemical components (mass %) | | | | | | | | | | | |
|---|---|---|---|---|---|---|---|---|---|---|---|---|---|
| | | C | N | Si | Mn | P | S | Cr | Cu | Ni | Mo | Nb | Ti |
| Invention Examples | 1 | 0.005 | 0.009 | 0.21 | 0.11 | 0.03 | 0.002 | 16.9 | 1.35 | 0.3 | 0.30 | 0.65 | 0.09 |
| | 2 | 0.005 | 0.008 | 0.40 | 0.12 | 0.03 | 0.002 | 15.5 | 0.95 | 0.3 | 0.30 | 0.51 | 0.09 |
| | 3 | 0.005 | 0.008 | 0.29 | 0.30 | 0.03 | 0.002 | 17.9 | 1.40 | 0.1 | 0.33 | 0.64 | 0.11 |
| | 4 | 0.004 | 0.008 | 0.31 | 0.92 | 0.03 | 0.001 | 17.7 | 1.39 | 0.1 | 1.10 | 0.56 | 0.12 |
| | 5 | 0.006 | 0.008 | 0.40 | 0.93 | 0.03 | 0.001 | 17.2 | 1.25 | 0.1 | 1.12 | 0.55 | 0.12 |
| | 6 | 0.004 | 0.008 | 0.40 | 0.31 | 0.03 | 0.002 | 17.2 | 1.26 | 0.1 | 0.31 | 0.53 | 0.11 |
| | 7 | 0.004 | 0.009 | 0.42 | 0.51 | 0.03 | 0.002 | 15.5 | 0.95 | 0.1 | 0.31 | 0.54 | 0.12 |
| | 8 | 0.009 | 0.011 | 0.49 | 0.20 | 0.02 | 0.002 | 17.2 | 1.25 | 0.1 | 0.32 | 0.53 | 0.10 |
| | 9 | 0.009 | 0.011 | 0.49 | 0.49 | 0.02 | 0.002 | 17.1 | 1.24 | 0.1 | 0.01 | 0.52 | 0.02 |
| | 10 | 0.009 | 0.011 | 0.49 | 0.76 | 0.02 | 0.002 | 17.2 | 1.24 | 0.1 | 0.02 | 0.52 | 0.02 |
| | 11 | 0.007 | 0.009 | 0.55 | 0.60 | 0.03 | 0.002 | 17.1 | 1.23 | 0.1 | 0.31 | 0.54 | 0.09 |
| | 12 | 0.004 | 0.007 | 0.72 | 0.22 | 0.03 | 0.001 | 13.8 | 1.15 | 0.1 | 0.07 | 0.87 | 0.16 |
| | 13 | 0.004 | 0.007 | 0.71 | 0.51 | 0.03 | 0.002 | 13.8 | 1.14 | 0.1 | 0.07 | 0.84 | 0.18 |
| | 14 | 0.004 | 0.007 | 0.72 | 0.81 | 0.03 | 0.001 | 19.2 | 1.14 | 0.1 | 0.07 | 0.35 | 0.16 |
| | 15 | 0.004 | 0.007 | 0.63 | 0.15 | 0.02 | 0.003 | 12.8 | 0.81 | 0.1 | 0.08 | 0.55 | 0.13 |

| | | Chemical components (mass %) | | | | Formula (1) | Formula (2) | Results of continuous oxidation test at 900° C. for 200 hours | |
|---|---|---|---|---|---|---|---|---|---|
| | | Al | V | B | Others | | | Mass gain ($mg/cm^2$) | Mass of spalled scale ($mg/cm^2$) |
| Invention Examples | 1 | 0.011 | 0.08 | 0.0002 | | 0.14 | −0.85 | 0.70 | 0.01 |
| | 2 | 0.082 | 0.12 | 0.0003 | | 0.41 | −0.63 | 0.67 | 0 |
| | 3 | 0.077 | 0.09 | 0.0003 | | 0.07 | −0.57 | 0.73 | 0.07 |
| | 4 | 0.126 | 0.05 | 0.0005 | | −0.52 | 0.07 | 1.14 | 0 |
| | 5 | 0.088 | 0.06 | 0.0005 | | −0.40 | 0.18 | 1.02 | 0 |
| | 6 | 0.094 | 0.05 | 0.0014 | | 0.22 | −0.44 | 0.75 | 0 |
| | 7 | 0.088 | 0.05 | 0.0050 | | 0.04 | −0.22 | 0.84 | 0.05 |
| | 8 | 0.101 | 0.05 | 0.0005 | | 0.46 | −0.45 | 0.68 | 0 |
| | 9 | 0.011 | 0.06 | 0.0005 | | 0.17 | −0.16 | 0.86 | 0.02 |
| | 10 | 0.003 | 0.05 | 0.0004 | | −0.10 | 0.11 | 1.01 | 0.01 |
| | 11 | 0.134 | 0.05 | 0.0005 | | 0.14 | 0.02 | 0.89 | 0.08 |
| | 12 | 0.038 | 0.02 | 0.0037 | W: 1.2 | 0.77 | −0.18 | 0.71 | 0 |
| | 13 | 0.169 | 0.02 | 0.0031 | Sn: 0.3 | 0.46 | 0.10 | 0.75 | 0 |
| | 14 | 0.026 | 0.01 | 0.0034 | W: 1.8<br>Sn: 0.2 | 0.18 | 0.41 | 0.89 | 0 |
| | 15 | 0.024 | 0.05 | 0.0004 | | 0.71 | −0.35 | 0.69 | 0 |

Formula (1): 1.44 × Si − Mn − 0.05

Formula (2): 1.10 × Si + Mn − 1.19

* Underlined values indicate that the values are not within the ranges of the invention

TABLE 2

| | | Chemical components (mass %) | | | | | | | | | | | |
|---|---|---|---|---|---|---|---|---|---|---|---|---|---|
| | | C | N | Si | Mn | P | S | Cr | Cu | Ni | Mo | Nb | Ti |
| Comparative Examples | 16 | 0.007 | 0.012 | 0.11 | 0.18 | 0.03 | 0.006 | 16.3 | 1.01 | 0.2 | 0.15 | 0.45 | 0.06 |
| | 17 | 0.007 | 0.011 | 0.12 | 0.54 | 0.03 | 0.006 | 16.2 | 1.02 | 0.2 | 0.16 | 0.46 | 0.07 |
| | 18 | 0.006 | 0.012 | 0.11 | 0.92 | 0.03 | 0.006 | 16.2 | 1.04 | 0.1 | 0.13 | 0.46 | 0.09 |
| | 19 | 0.004 | 0.009 | 0.21 | 0.29 | 0.03 | 0.002 | 16.9 | 1.34 | 0.3 | 0.30 | 0.61 | 0.08 |
| | 20 | 0.005 | 0.010 | 0.21 | 0.88 | 0.03 | 0.003 | 16.9 | 1.34 | 0.3 | 0.30 | 0.61 | 0.09 |
| | 21 | 0.005 | 0.008 | 0.20 | 0.66 | 0.03 | 0.002 | 17.0 | 1.36 | 0.3 | 0.30 | 0.35 | 0.12 |
| | 22 | 0.003 | 0.008 | 0.31 | 0.50 | 0.03 | 0.002 | 17.8 | 1.40 | 0.1 | 0.32 | 0.36 | 0.10 |
| | 23 | 0.010 | 0.008 | 0.31 | 0.72 | 0.03 | 0.003 | 17.8 | 1.41 | 0.1 | 0.32 | 0.35 | 0.10 |
| | 24 | 0.005 | 0.008 | 0.41 | 0.71 | 0.03 | 0.002 | 15.6 | 0.95 | 0.1 | 1.10 | 0.55 | 0.10 |
| | 25 | 0.004 | 0.009 | 0.22 | 0.50 | 0.03 | 0.003 | 17.2 | 1.26 | 0.1 | 0.31 | 0.54 | 0.11 |
| | 26 | 0.011 | 0.010 | 0.01 | 0.95 | 0.03 | 0.008 | 12.3 | 1.40 | 0.4 | 0.08 | 0.32 | 0.07 |
| | 27 | 0.011 | 0.010 | 0.21 | 0.98 | 0.02 | 0.007 | 11.8 | 1.40 | 0.6 | 0.09 | 0.32 | 0.14 |
| | 28 | 0.010 | 0.012 | 0.22 | 0.97 | 0.02 | 0.006 | 12.4 | 1.40 | 0.4 | 0.00 | 0.31 | 0.12 |
| | 29 | 0.012 | 0.012 | 0.21 | 0.98 | 0.03 | 0.008 | 12.2 | 1.41 | 0.3 | 0.09 | 0.05 | 0.09 |
| | 30 | 0.010 | 0.011 | 0.21 | 0.98 | 0.02 | 0.004 | 12.3 | 1.41 | 0.3 | 0.09 | 0.32 | 0.00 |
| | 31 | 0.012 | 0.011 | 0.25 | 0.95 | 0.03 | 0.006 | 12.5 | 1.41 | 0.5 | 0.07 | 0.32 | 0.05 |
| | 32 | 0.011 | 0.011 | 0.25 | 0.94 | 0.03 | 0.005 | 12.4 | 1.41 | 0.4 | 0.08 | 0.31 | 0.15 |
| | 33 | 0.012 | 0.012 | 0.26 | 0.95 | 0.03 | 0.008 | 12.4 | 1.40 | 0.3 | 0.09 | 0.31 | 0.13 |
| | 34 | 0.036 | 0.012 | 0.24 | 0.94 | 0.02 | 0.008 | 12.3 | 1.40 | 0.4 | 0.09 | 0.31 | 0.08 |
| | 35 | 0.012 | 0.042 | 0.23 | 0.95 | 0.03 | 0.007 | 12.4 | 1.41 | 0.5 | 0.08 | 0.31 | 0.09 |
| | 36 | 0.010 | 0.013 | 0.23 | 1.34 | 0.02 | 0.006 | 12.3 | 1.42 | 0.5 | 0.08 | 0.31 | 0.07 |

TABLE 2-continued

| | | | | | | | | | | | | |
|---|---|---|---|---|---|---|---|---|---|---|---|---|
| 37 | 0.012 | 0.012 | 0.22 | 0.99 | 0.03 | 0.006 | 12.3 | 1.96 | 0.3 | 0.07 | 0.31 | 0.09 |
| 38 | 0.011 | 0.011 | 0.21 | 0.97 | 0.02 | 0.007 | 12.4 | 1.40 | 1.4 | 0.09 | 0.32 | 0.09 |
| 39 | 0.012 | 0.012 | 0.45 | 0.01 | 0.03 | 0.007 | 12.4 | 1.41 | 0.3 | 0.07 | 0.33 | 0.07 |
| 40 | 0.011 | 0.010 | 1.13 | 0.35 | 0.02 | 0.008 | 12.4 | 1.40 | 0.4 | 0.09 | 0.31 | 0.08 |
| 41 | 0.012 | 0.010 | 0.21 | 0.99 | 0.03 | 0.023 | 12.4 | 1.40 | 0.5 | 0.07 | 0.32 | 0.08 |

| | | Chemical components (mass %) | | | | Formula (1) | Formula (2) | Results of continuous oxidation test at 900° C. for 200 hours | |
|---|---|---|---|---|---|---|---|---|---|
| | | Al | V | B | Others | | | Mass gain ($mg/cm^2$) | Mass of spalled scale ($mg/cm^2$) |
| Comparative Examples | 16 | 0.041 | 0.06 | 0.0006 | | −0.07 | −0.89 | 0.87 | 0.67 |
| | 17 | 0.038 | 0.07 | 0.0007 | | −0.42 | −0.52 | 0.99 | 1.24 |
| | 18 | 0.049 | 0.09 | 0.0007 | | −0.81 | −0.15 | 1.22 | 0.41 |
| | 19 | 0.012 | 0.08 | 0.0002 | | −0.04 | −0.67 | 0.85 | 0.32 |
| | 20 | 0.014 | 0.09 | 0.0003 | | −0.63 | −0.08 | 1.20 | 0.32 |
| | 21 | 0.035 | 0.05 | 0.0003 | | −0.42 | −0.31 | 1.10 | 0.64 |
| | 22 | 0.052 | 0.05 | 0.0003 | | −0.10 | −0.35 | 0.93 | 0.36 |
| | 23 | 0.081 | 0.05 | 0.0002 | | −0.32 | −0.13 | 1.12 | 0.42 |
| | 24 | 0.078 | 0.11 | 0.0005 | | −0.17 | −0.03 | 1.05 | 0.31 |
| | 25 | 0.074 | 0.10 | 0.0004 | | −0.23 | −0.45 | 1.07 | 0.84 |
| | 26 | 0.010 | 0.04 | 0.0005 | | −0.99 | −0.23 | 3.19 | x |
| | 27 | 0.021 | 0.05 | 0.0005 | | −0.73 | 0.02 | 2.45 | x |
| | 28 | 0.024 | 0.04 | 0.0004 | | −0.70 | 0.02 | 1.94 | x |
| | 29 | 0.017 | 0.05 | 0.0004 | | −0.73 | 0.02 | 1.54 | x |
| | 30 | 0.017 | 0.05 | 0.0004 | | −0.73 | 0.02 | 2.11 | x |
| | 31 | 0.002 | 0.05 | 0.0004 | | −0.64 | 0.04 | 2.52 | x |
| | 32 | 0.013 | 0.00 | 0.0002 | | −0.63 | 0.02 | 1.62 | x |
| | 33 | 0.009 | 0.05 | 0.0001 | | −0.63 | 0.05 | 1.57 | x |
| | 34 | 0.012 | 0.05 | 0.0004 | | −0.64 | 0.01 | 7.13 | x |
| | 35 | 0.013 | 0.05 | 0.0004 | | −0.67 | 0.01 | 9.74 | x |
| | 36 | 0.014 | 0.04 | 0.0003 | | −1.06 | 0.40 | 2.63 | x |
| | 37 | 0.012 | 0.04 | 0.0004 | | −0.72 | 0.04 | 6.35 | x |
| | 38 | 0.009 | 0.05 | 0.0005 | | −0.72 | 0.01 | 4.92 | x |
| | 39 | 0.016 | 0.05 | 0.0004 | | 0.59 | −0.69 | 0.64 | 0.74 |
| | 40 | 0.008 | 0.05 | 0.0003 | | 1.23 | 0.40 | 0.72 | 0.98 |
| | 41 | 0.010 | 0.05 | 0.0004 | | −0.74 | 0.03 | 1.28 | 1.37 |

Formula (1): 1.44 × Si − Mn − 0.05

Formula (2): 1.10 × Si + Mn − 1.19

* Underlined values indicate that the values are not within the ranges of the invention In the oxidation test, a resistance heating-type muffle furnace was used, and KANTHAL AF (registered trademark) that could be heated up to a maximum of 1150° C. was used in the muffle furnace. The oxidation test specimens were placed inclined toward an inner surface of an alumina crucible having an outer diameter of 46 mm and a height of 36 mm and were installed in the furnace. The oxidation test specimens were heated to 150° C. to be dried until the start of the test, and the oxidation test specimens were heated up to 850° C. at a rate of 0.26° C./second, and then were heated up to 900° C. at a rate of 0.06° C./second so as to prevent the overheating. The oxidation test specimens were held at 900° C. for 200 hours in still air, and then cooled to 500° C. in the furnace. When the oxidation test specimens were cooled to 500° C., the crucible was removed from the furnace, and the crucible was covered with an alumina lid so as to prevent the loss of scales by scattering in the case where the scales were spalled off, and the spalled scale pieces were collected. A value obtained by dividing the value of the weight increase of the oxidation test specimen including the spalled scales by the value of the surface area of the oxidation test specimen was used as a mass gain, and a value obtained by dividing the value of the weight of the spalled scales by the value of the surface area of the oxidation test specimen was used as a mass of spalled scale. The oxidation resistance and the resistance against scale spallation were evaluated using the mass gain and the mass of spalled scale in the continuous oxidation test in air at 900° C. for 200 hours as described above. Test specimens having a mass gain of 1.50 $mg/cm^2$ or less were evaluated to have favorable oxidation resistance. Test specimens having a mass of spalled scale of 0.30 $mg/cm^2$ or less were evaluated to have favorable resistance against scale spallation.

The results are described in Tables 1 and 2.

In Table 2, all of Comparative Steels 16, 17, 19, 22, and 25 fail to satisfy Formula (1) in the case of Mn<0.65%, and all of Comparative Steels 20, 21, 23, and 24 fail to satisfy Formula (2) in the case of Mn≥0.65%, and these Comparative Steels have sufficient oxidation resistance, but have insufficient resistance against scale spallation.

Comparative Steel 26 has a content of Si below the lower limit of the appropriate range. Comparative Steel 27 has a content of Cr below the lower limit of the appropriate range. Comparative Steel 28 has a content of Mo below the lower limit of the appropriate range. Comparative Steel 29 has a content of Nb below the lower limit of the appropriate range. Comparative Steel 30 has a content of Ti below the lower limit of the appropriate range. Comparative Steel 31 has a content of Al below the lower limit of the appropriate range. Comparative Steel 32 has a content of V below the lower limit of the appropriate range. Comparative Steel 33 has a content of B below the lower limit of the appropriate range. All of these Comparative Steels have insufficient oxidation resistance.

In addition, Comparative Steel 34 has a content of C above the upper limit of the appropriate range. Comparative Steel 35 has a content of N above the upper limit of the appropriate range. Comparative Steel 36 has a content of Mn above the upper limit of the appropriate range. Comparative Steel 37 has a content of Cu above the upper limit of the appropriate range. Comparative Steel 38 has a content of Ni above the upper limit of the appropriate range. All of these Comparative Steels have insufficient oxidation resistance.

Furthermore, Comparative Steel 39 has a content of Mn below the lower limit of the appropriate range. Comparative Steel 40 has a content of Si above the upper limit of the appropriate range. Comparative Steel 41 has a content of S above the upper limit of the appropriate range. All of these Comparative Steels have sufficient oxidation resistance, but have insufficient resistance against scale spallation.

As is evident from what has been described above, it is found that steels having a component composition specified in the embodiment have mass gains and masses of spalled scale after the continuous oxidation test in air at 900° C. for 200 hours that are extremely small compared with those of Comparative Steels, and the steels have excellent oxidation resistance and resistance against scale spallation.

Next, the cold-rolled sheets having a thickness of 1.5 mm of Invention Steels 3, 5, and 11 in Table 1 were subjected to final annealing and finishing pickling under individual conditions described in Table 3. Meanwhile, as the finishing pickling, Invention Examples a and b and Comparative Examples f, g, j, 1, and o were subjected to dipping treatment in a nitric hydrofluoric acid aqueous solution, and Invention Examples c and d and Comparative Examples e, h, i, k, m, and n were subjected to electrolytic treatment in a nitric acid aqueous solution.

In addition, before the finishing pickling, alumina blasting and an electrolytic treatment in a neutral salt solution were carried out to an extent that scales were not removed. Test specimens having a thickness of 1.5 mm, a width of 20 mm and a length of 25 mm were sampled from the cold-rolled, annealed and pickled sheets obtained in the above-described manner, and test specimens were used as test specimens for the glow discharge optical emission spectrometry (GDS) and the oxidation test.

TABLE 3

| | | Final annealing conditions | | | | | Finishing pickling conditions | | |
|---|---|---|---|---|---|---|---|---|---|
| | | Steel type (refer to Tables 1 and 2) | Oxygen proportion (vol %) | Oxygen/(hydrogen + carbon monoxide + hydrocarbon) (volume ratio) | Annealing temperature T (° C.) | Annealing time A (sec) | Hydrofluoric acid concentration F (mass %) | Nitric acid concentration N (mass %) | Electrolysis current density J (mA/cm$^2$) |
| Invention Examples | a | 3 | 1.3 | 5.7 | 1010 | 80 | 2.1 | 10.2 | 0 |
| | b | 5 | 13.5 | 1928.6 | 860 | 150 | 3.0 | 6.9 | 0 |
| | c | 11 | 2.4 | 31.2 | 930 | 100 | 0.0 | 19.8 | 300 |
| | d | 3 | 20.4 | 10200.0 | 1100 | 40 | 0.0 | 16.1 | 200 |
| Comparative Examples | e | 5 | 15.3 | 3060.0 | 1150 | 40 | 0.0 | 16.2 | 250 |
| | f | 3 | 26.4 | 676.9 | 970 | 180 | 2.7 | 9.8 | 0 |
| | g | 3 | 15.9 | 883.3 | 860 | 100 | 5.1 | 7.6 | 0 |
| | h | 11 | 24.6 | 2733.3 | 1000 | 60 | 0.0 | 24.9 | 250 |
| | i | 3 | 9.0 | 132.4 | 1020 | 30 | 0.0 | 16.1 | 350 |
| | j | 5 | 14.4 | 105.1 | 990 | 90 | 2.2 | 8.0 | 0 |
| | k | 11 | 2.1 | 15.9 | 890 | 70 | 0.0 | 13.9 | 200 |
| | l | 11 | 21.6 | 4320.0 | 980 | 130 | 2.9 | 8.1 | 0 |
| | m | 5 | 4.8 | 25.1 | 940 | 80 | 0.0 | 14.0 | 250 |
| | n | 3 | 0.2 | 6.5 | 910 | 110 | 0.0 | 19.7 | 250 |
| | o | 11 | 1.4 | 3.9 | 870 | 120 | 2.8 | 10.1 | 0 |

| | | Finishing pickling conditions | | | Average Cu concentration in area from surface to 200 nm (mass %) | Results of continuous oxidation test at 900° C. for 200 hours | |
|---|---|---|---|---|---|---|---|
| | | Pickling time P (sec) | Current applying time I (sec) | Formula (3) | | Mass gain (mg/cm$^2$) | Mass of spalled scale (mg/cm$^2$) |
| Invention Examples | a | 240 | 0 | 4.7 | 2.17 | 0.72 | 0.00 |
| | b | 185 | 0 | 4.8 | 1.99 | 1.03 | 0.01 |
| | c | 155 | 31 | 4.8 | 2.70 | 0.89 | 0.02 |
| | d | 190 | 50 | 4.9 | 2.35 | 0.71 | 0.07 |
| Comparative Examples | e | 215 | 43 | 5.5 | 4.27 | 1.06 | 0.49 |
| | f | 185 | 0 | 5.2 | 3.74 | 0.75 | 0.78 |
| | g | 140 | 0 | 5.5 | 4.14 | 0.73 | 0.62 |
| | h | 230 | 41 | 5.6 | 3.77 | 0.90 | 0.70 |
| | i | 145 | 39 | 5.4 | 3.79 | 0.72 | 0.48 |
| | j | 280 | 0 | 5.6 | 3.51 | 1.03 | 0.43 |
| | k | 220 | 62 | 5.5 | 4.03 | 0.91 | 0.66 |
| | l | 195 | 0 | 5.4 | 3.57 | 0.86 | 0.67 |
| | m | 215 | 43 | 5.3 | 3.31 | 1.01 | 0.65 |
| | n | 180 | 36 | 4.8 | 3.17 | 0.71 | 0.42 |
| | o | 200 | 0 | 4.8 | 3.25 | 0.90 | 0.40 |

Formula (3): $T \times \log A \times ((4.3 \times F + 0.12 \times N) \times P + 0.24 \times J \times I) \times 10^{-6}$

* Underlined values indicate that the values are not within the ranges of the invention.

In the GDS analysis, the concentration distribution of O, Fe, Cr, Si, Mn, Mo, Nb, Ti, Al and Cu was measured in an area from the surface of the test specimen to a depth of approximately 800 nm. At this time, the Cu concentration obtained through GDS analysis is expressed as the Cu concentration with respect to the total amount of O, Fe, Cr, Si, Mn, Mo, Nb, Ti, Al and Cu. The average Cu concentration in an area from the surface to a depth of 200 nm is computed using the above-described Cu concentration. Here, the surface includes a passivation film.

As the oxidation test, the same oxidation test as the above-described method was carried out.

The results are described in Table 3.

In Table 3, all of Comparative Examples e, f, g, h, i, j, k, l, m, n, and o are examples having an average Cu concentration in an area from the surface to a depth of 200 nm of more than 3.00%, and have insufficient resistance against scale spallation.

Comparative Example e has an annealing temperature T above the upper limit of the appropriate range. Comparative Example f has an annealing time A above the upper limit of the appropriate range. Comparative Example g has a hydrofluoric acid concentration F above the upper limit of the appropriate range. Comparative Example h has a nitric acid concentration N above the upper limit of the appropriate range. Comparative Example i has an electrolysis current density J above the upper limit of the appropriate range. Comparative Example j has a pickling time P above the upper limit of the appropriate range. Comparative Example k has a current applying time I above the upper limit of the appropriate range. In all of these Comparative Examples, Formula (3) is not satisfied, an average Cu concentration in an area from the surface to a depth of 200 nm is more than 3.00%, and resistance against scale spallation is insufficient.

In addition, in Comparative Examples l and m, an annealing temperature T, an annealing time A, a hydrofluoric acid concentration F, a nitric acid concentration N, an electrolysis current density J, a pickling time P, and a current applying time I are in appropriate ranges, but Formula (3) is not satisfied, an average Cu concentration in an area from the surface to a depth of 200 nm is more than 3.00%, and resistance against scale spallation is insufficient.

Furthermore, in Comparative Examples n and o, an annealing temperature T, an annealing time A, a hydrofluoric acid concentration F, a nitric acid concentration N, an electrolysis current density J, a pickling time P, and a current applying time I are in appropriate ranges, and Formula (3) is satisfied. However, Comparative Example n has an oxygen proportion in the atmosphere of the final annealing below the lower limit of the appropriate range. Comparative Example o has a volume ratio of oxygen/(hydrogen+carbon monoxide+hydrocarbon) in the atmosphere of the final annealing below the lower limit of the appropriate range. In both of these Comparative Examples, an average Cu concentration in an area from the surface to a depth of 200 nm is more than 3.00%, and resistance against scale spallation is insufficient.

As is evident from what has been described above, it is found that steels having a component composition specified in the embodiment and having an average Cu concentration in an area from the surface to a depth of 200 nm of 3.00% or less have mass gains and masses of spalled scale after the continuous oxidation test in air at 900° C. for 200 hours that are extremely small compared with those of Comparative Steels, and the steels have excellent oxidation resistance and resistance against scale spallation. In addition, it is found that steels obtained by subjecting steels having a component composition specified in the embodiment to the final annealing and the finishing pickling under the conditions specified in the embodiment have an average Cu concentration in an area from the surface to a depth of 200 nm of 3.00% or less.

Based on what has been described above, it is evident that the invention has extremely excellent characteristics.

INDUSTRIAL APPLICABILITY

The ferritic stainless steel sheet of the embodiment has excellent resistance against scale spallation. Therefore, the ferritic stainless steel sheet of the embodiment can be preferably applied to members in an exhaust system such as an exhaust manifold, a front pipe, and a center pipe in a vehicle.

The invention claimed is:

1. A ferritic stainless steel sheet comprising, by mass %:
C: 0.02% or less;
N: 0.02% or less;
Si: 0.05% to 0.80%;
Mn: 0.05% to 1.00%;
P: 0.04% or less;
S: 0.01% or less;
Cr: 12% to 20%;
Cu: 0.80% to 1.50%;
Ni: 1.0% or less;
Mo: 0.01% to 2.00%;
Nb: 0.30% to 1.00%;
Ti: 0.01% to less than 0.25%;
Al: 0.003% to 0.169%;
V: 0.01% to less than 0.15%; and
B: 0.0002% to 0.0050%,
with a remainder of Fe and inevitable impurities,
wherein the following formulae (1) and (2) are satisfied, and an average Cu concentration in an area from a surface to a depth of 200 nm is in a range of 3.00 mass % or less,
in the case of Mn<0.65%, $$1.44\times Si-Mn-0.06>=0 \quad (1) \text{ and}$$

in the case of Mn>=0.65%, $$1.10\times Si+Mn-1.19>=0 \quad (2),$$

herein, element symbols in the formulae represent mass % of the corresponding elements.

2. The ferritic stainless steel sheet according to claim 1, wherein a mass gain is in a range of 1.50 mg/cm$^2$ or less and a mass of spalled scale is in a range of 0.30 mg/cm$^2$ or less after a continuous oxidation test in air at 900° C. for 200 hours.

3. The ferritic stainless steel sheet according to claim 1, which further comprises, by mass %, one or two of W: 5% or less and Sn: 1% or less.

4. A method for manufacturing the ferritic stainless steel sheet according to claim 1,
the method comprising: final annealing; and finishing pickling, wherein the ferritic stainless steel sheet of claim 1 is produced,
wherein the final annealing is carried out in an oxidizing atmosphere having an oxygen proportion of 1.0 vol % or more and a volume ratio of oxygen/(hydrogen+carbon monoxide+hydrocarbon) of 5.0 or more, an annealing temperature T is set to be in a range of 850° C. to 1100° C., and an annealing time A is set to be in a range of 150 seconds or less, the finishing pickling is carried out through dipping treatment in a nitric hydrofluoric acid aqueous solution or electrolytic treatment in a nitric acid aqueous solution, in the case where the dipping treatment in a nitric hydrofluoric acid aqueous solution is carried out, a nitric acid concentration N is set to be in a range of 3.0 mass % to 20.0 mass %, a hydrofluoric acid concentration F is set to be in a range of 3.0 mass % or less, and a pickling time P is set to be in a range of 240 seconds or less, in the case where the electrolytic treatment in a nitric acid aqueous solution is carried out, a nitric acid concentration N is set to be in a range of 3.0 mass % to 20.0 mass %, an electrolysis current density J is set to be in a range of 300 mA/cm$^2$ or less, a current applying time I is set to be in a range of 50 seconds or less, and a pickling time P is set to be in a range of 240 seconds or less, and conditions of the final annealing and the finishing pickling fulfill the following formula (3), $$T\times\log A\times((4.3\times F+0.12\times N)\times P+0.24\times J\times I)\times10^{-6}<=5.0 \quad (3).$$

5. The ferritic stainless steel sheet according to claim 2, which further comprises, by mass %, one or two of W: 5% or less and Sn: 1% or less.

6. A method for manufacturing the ferritic stainless steel sheet according to claim 2, the method comprising: final annealing; and finishing pickling, wherein the ferritic stainless steel sheet of claim 2 is produced, wherein the final annealing is carried out in an oxidizing atmosphere having an oxygen proportion of 1.0 vol % or more and a volume ratio of oxygen/(hydrogen+carbon monoxide+hydrocarbon) of 5.0 or more, an annealing temperature T is set to be in a range of 850° C. to 1100° C., and an annealing time A is set to be in a range of 150 seconds or less, the finishing pickling is carried out through dipping treatment in a nitric hydrofluoric acid aqueous solution or electrolytic treatment in a nitric acid aqueous solution, in the case where the dipping treatment in a nitric hydrofluoric acid aqueous solution is carried out, a nitric acid concentration N is set to be in a range of 3.0 mass % to 20.0 mass %, a hydrofluoric acid concentration F is set to be in a range of 3.0 mass % or less, and a pickling time P is set to be in a range of 240 seconds or less, in the case where the electrolytic treatment in a nitric acid aqueous solution is carried out, a nitric acid concentration N is set to be in a range of 3.0 mass % to 20.0 mass %, an electrolysis current density J is set to be in a range of 300 mA/cm$^2$ or less, a current applying time I is set to be in a range of 50 seconds or less, and a pickling time P is set to be in a range of 240 seconds or less, and conditions of the final annealing and the finishing pickling fulfill the following formula (3), $$T\times\log A\times((4.3\times F+0.12\times N)\times P+0.24\times J\times I)\times10^{-6}<=5.0 \quad (3).$$

7. A method for manufacturing the ferritic stainless steel sheet according to claim 3, the method comprising: final annealing; and finishing pickling, wherein the ferritic stainless steel sheet of claim 3 is produced, wherein the final annealing is carried out in an oxidizing atmosphere having an oxygen proportion of 1.0 vol % or more and a volume ratio of oxygen/(hydrogen+carbon monoxide+hydrocarbon) of 5.0 or more, an annealing temperature T is set to be in a range of 850° C. to 1100° C., and an annealing time A is set to be in a range of 150 seconds or less, the finishing pickling is carried out through dipping treatment in a nitric hydrofluoric acid aqueous solution or electrolytic treatment in a nitric acid aqueous solution, in the case where the dipping treatment in a nitric hydrofluoric acid aqueous solution is carried out, a nitric acid concentration N is set to be in a range of 3.0 mass % to 20.0 mass %, a hydrofluoric acid concentration F is set to be in a range of 3.0 mass % or less, and a pickling time P is set to be in a range of 240 seconds or less, in the case where the electrolytic treatment in a nitric acid aqueous solution is carried out, a nitric acid concentration N is set to be in a range of 3.0 mass % to 20.0 mass %, an electrolysis current density J is set to be in a range of 300 mA/cm$^2$ or less, a current applying time I is set to be in a range of 50 seconds or less, and a pickling time P is set to be in a range of 240 seconds or less, and conditions of the final annealing and the finishing pickling fulfill the following formula (3), $$T\times\log A\times((4.3\times F+0.12\times N)\times P+0.24\times J\times I)\times10^{-6}<=5.0 \quad (3).$$

8. A method for manufacturing the ferritic stainless steel sheet according to claim 5, the method comprising: final annealing; and finishing pickling, wherein the ferritic stainless steel sheet of claim 5 is produced, wherein the final annealing is carried out in an oxidizing atmosphere having an oxygen proportion of 1.0 vol % or more and a volume ratio of oxygen/(hydrogen+carbon monoxide+hydrocarbon) of 5.0 or more, an annealing temperature T is set to be in a range of 850° C. to 1100° C., and an annealing time A is set to be in a range of 150 seconds or less, the finishing pickling is carried out through dipping treatment in a nitric hydrofluoric acid aqueous solution or electrolytic treatment in a nitric acid aqueous solution, in the case where the dipping treatment in a nitric hydrofluoric acid aqueous solution is carried out, a nitric acid concentration N is set to be in a range of 3.0 mass % to 20.0 mass %, a hydrofluoric acid concentration F is set to be in a range of 3.0 mass % or less, and a pickling time P is set to be in a range of 240 seconds or less, in the case where the electrolytic treatment in a nitric acid aqueous solution is carried out, a nitric acid concentration N is set to be in a range of 3.0 mass % to 20.0 mass %, an electrolysis current density J is set to be in a range of 300 mA/cm$^2$ or less, a current applying time I is set to be in a range of 50 seconds or less, and a pickling time P is set to be in a range of 240 seconds or less, and conditions of the final annealing and the finishing pickling fulfill the following formula (3), $$T\times\log A\times((4.3\times F+0.12\times N)\times P+0.24\times J\times I)\times10^{-6}<=5.0 \quad (3).$$

* * * * *